US006440855B1

(12) United States Patent
Miyazawa et al.

(10) Patent No.: US 6,440,855 B1
(45) Date of Patent: Aug. 27, 2002

(54) METHOD OF PROCESSING SURFACE OF WORKPIECE AND METHOD OF FORMING SEMICONDUCTOR THIN LAYER

(75) Inventors: Yoshihiro Miyazawa; Shuzo Sato, both of Kanagawa (JP)

(73) Assignee: Sony Corporation, Tokyo (JP)

( * ) Notice: Subject to any disclaimer, the term of this patent is extended or adjusted under 35 U.S.C. 154(b) by 402 days.

(21) Appl. No.: 09/025,551

(22) Filed: Feb. 18, 1998

(30) Foreign Application Priority Data

Feb. 19, 1997 (JP) ..... 9-034954

(51) Int. Cl.[7] ..... H01L 21/302
(52) U.S. Cl. ..... 438/690; 438/691
(58) Field of Search ..... 438/690, 691, 438/692, 693

(56) References Cited

U.S. PATENT DOCUMENTS 4,962,056 A * 10/1990 Yamaki et al. ..... 437/62
5,223,080 A * 6/1993 Ohta et al. ..... 156/626
5,429,711 A * 7/1995 Watanabe et al. ..... 438/692
5,529,051 A * 6/1996 Miller ..... 125/12

* cited by examiner

*Primary Examiner*—Benjamin L. Utech
*Assistant Examiner*—Kin-Chan Chen
(74) *Attorney, Agent, or Firm*—Sonnenschein, Nath & Rosenthal

(57) ABSTRACT

In a workpiece surface processing method and a semiconductor thin layer forming method, a reference plane (12) is set in a workpiece, the reference plane (12) is controlled to a desired shape, and then the material constituting the workpiece is removed from the surface of the workpiece (10) toward the reference plane (12) is removed. The surface processing of the workpiece can be performed with high precision while not being dependent on the thickness precision of the workpiece before the surface processing.

8 Claims, 14 Drawing Sheets

METHOD OF PROCESSING SURFACE OF WORKPIECE AND METHOD OF FORMING SEMICONDUCTOR THIN LAYER

BACKGROUND OF THE INVENTION

The present invention relates to a method of processing the surface of a workpiece and a method of forming a semiconductor thin layer.

In some cases, an SOI (Silicon On Insulator) wafer including two semiconductor wafers which are bonded on each other is required to be manufactured. The manufacturing process of the SOI wafer as described above will be described briefly.

[Step-10]

First, the surface of a first semiconductor wafer 11 which is formed of a silicon semiconductor wafer is thermally oxidized to form an oxide film 12 of 0.3 $\mu$m in film thickness on the surface of the first semiconductor wafer 11. Further, a second semiconductor wafer 13 formed of a silicon semiconductor wafer is prepared. A surface treatment is performed on the first and second semiconductor wafers 11 and 13 with a chemical of a hydrogen peroxide water group such as $NH_4OH/H_2O_2/H_2O$ or $H_2SO_4/H_2O_2/H_2O$ to terminate the surface of the first and second semiconductor wafers 11 and 13 with OH-groups and form a bonding face on each of the first and second semiconductor wafers 11 and 13. Thereafter, when the bonding faces of the first and second semiconductor wafers 11 and 13 are brought into contact with each other, the first and second semiconductor wafers 11 and 13 are attached to each other by van der Waals. Thereafter, an anneal treatment at a temperature of 1100° C. and for 2 hours is performed to release the OH-groups, thereby obtaining strong Si—Si coupling. Accordingly, the bonding of the first and second semiconductor wafers 11 and 13 can be achieved as shown in a schematic partially cross-sectional view of FIG. 1A.

[Step-20]

Subsequently, the first semiconductor wafer 11 is grounded or polished to thin the first semiconductor wafer 11 and form a semiconductor thin layer from the first semiconductor wafer 11, whereby an SOI wafer can be obtained.

[Step-30]

Thereafter, for example, a transistor device is formed in the semiconductor thin layer on the basis of a well-known method if occasion demands.

When an 8-inch wafer is used as the silicon semiconductor wafer, the average thickness of the silicon semiconductor wafer is equal to 725 $\mu$m, and the in-plane thickness precision is equal to ±15 $\mu$m. In the case of a high-precision silicon semiconductor wafer, the in-plane thickness precision is equal to about ±1.5 $\mu$m, for example. A thickness precision of about ± several nm to about ±several hundreds nm is needed as the demanded thickness precision of the semiconductor thin layer although it is varied in accordance with the applied field, and thus the thickness precision is required to be higher by one order to four orders of magnitude than the thickness precision of the silicon semiconductor wafer.

Nevertheless, the grinding/polishing work with respect to the back surface of the first semiconductor wafer 11 or the grinding/polishing work with respect to the back surface of the second semiconductor wafer 13 is performed in the conventional technique, so that the thickness precision of the semiconductor thin layer after the grinding/polishing work is low, and it is equal to about ±500 nm.

[Step-20] will be described in detail with reference to FIG. 2.

FIG. 2A shows a grinding/polishing work with respect to the back surface of the second semiconductor wafer 13. In the grinding work, the back surface of the second semiconductor wafer 13 is fixed onto a wafer stage by a vacuum suction device (not shown), and the grinding/polishing work is performed with respect to the adsorbing face of the wafer stage (in other words, the back surface of the second semiconductor wafer 13). In this case, the grinding/polishing work is performed on the first semiconductor wafer 11 from the back surface thereof in parallel to the adsorbing face of the wafer stage to form a semiconductor thin layer 14. A dotted line A—A of FIG. 2A corresponds to the finished surface of the semiconductor thin layer 14, and a portion of the first semiconductor wafer 11 between the dotted line A—A and the oxide film 12 corresponds to the semiconductor thin layer 14.

As is apparent from FIG. 2A, even if it is assumed that the dispersion of the grinding/polishing work is small to the extent that it is negligible, the dispersion having the same level as the in-plane thickness precision of the second semiconductor wafer 13 occurs in the thickness of the semiconductor thin layer 14. The grinding work precision when a high-precision grinding machine is used is equal to about ±300 nm. Accordingly, a precision of several hundreds cannot be achieved as the thickness precision of the semiconductor thin layer 14 unless a higher-precision silicon semiconductor wafer is selected as the second semiconductor wafer 13 from the high-precision silicon semiconductor wafers.

FIG. 2B shows the polishing work with respect to the back surface of the first semiconductor wafer 11. In the polishing work, an abrasive cloth which is attached onto a polishing fixed table and the back surface of the first semiconductor wafer 11 are confronted to each other. The abrasive cloth and the first and second semiconductor wafers 11 and 13 are rotated while abrasive grains (not shown) are interposed between the abrasive cloth and the back surface of the first semiconductor wafer 11, thereby polishing the back surface of the first semiconductor wafer 11. At this time, the semiconductor wafer is held by suitably pressing the overall first semiconductor wafer 11 so that the back surface of the first semiconductor wafer 11 is brought into contact with the abrasive cloth as flatly as possible. A dotted line B—B of FIG. 2B corresponds to the finished surface of the semiconductor thin layer 14, and a portion of the first semiconductor wafer 11 between the dotted line B—B and the oxide film 12 corresponds to the semiconductor thin layer 14. As is apparent from FIG. 2B, the back surface of the first semiconductor wafer 11 is equi-quantitatively polished on the overall surface from the initial surface state, so that the dispersion having the same level as the in-plane thickness precision of the first semiconductor wafer 11 occurs in the semiconductor thin layer 14.

In general, a polishing machine is more deteriorated in processing precision and processing speed than a grinding machine. Conversely, the roughness on the finished surface (unevenness state) is more excellent in the polishing machine. Accordingly, it is practically preferable that the back surface of the first semiconductor wafer 11 is ground by using the grinding machine in accordance with specifications of the semiconductor thin layer 14 so that the thickness thereof is larger than the desired thickness of the semiconductor thin layer 14 by several $\mu$m, and then the first semiconductor wafer 11 is polished by using the polisher so that the thickness thereof is equal to the desired thickness of the semiconductor thin layer.

In the cases of FIGS. 2A and 2B, any sufficient work precision cannot be obtained. That is, any semiconductor layer 14 having the desired thickness precision cannot be obtained.

The main cause is as follows. That is, the grinding/polishing work is performed with respect to the back surface of any one of the bonded semiconductor wafers, and thus any semiconductor thin layer 14 having a thickness precision which is higher than the original thickness precision of the first or second semiconductor wafer 11, 13 cannot be obtained.

A partial polishing method or a partial etching method has been proposed as a countermeasure of solving the above problem. FIG. 3 shows a polishing work of the back surface of the first semiconductor wafer 11 by the partial polishing method. In the partial polishing method, the thickness of the first semiconductor wafer 11 which remains after the polishing is measured, and the polishing work based on the measurement data thus obtained is controlled, so that the polishing work with respect to the oxide film 12 in the semiconductor wafer after the bonding can be performed. However, the shape (planar shape) of the oxide film 12 serving as the reference is not fixed, and it is normally uneven. Therefore, a partial polishing work is needed.

In the case of FIG. 3, the partial polishing work using a polishing head is performed. The diameter of the polishing head is equal to 10 mm, for example. As indicated by a dotted line, the surface of the semiconductor thin layer 14 thus obtained is designed in a step form. When the back surface of the first semiconductor wafer 11 is processed (or etched) by a dry etching method using a plasma generator for generating plasma of about 10 mm in diameter in place of use of the polishing head, the surface of the semiconductor thin layer 14 thus obtained is also designed in a step form.

The thickness precision of the semiconductor thin layer thus obtained can be enhanced as the area of the polishing head is reduced. For example, a processing example of a semiconductor thin layer having a high-precision thickness of ±10 nm, for example has been reported. As described above, the polishing work with respect to the oxide film 12 can be performed, and thus the high-precision work can be obtained. However, the partial polishing work is repeated, and thus if the processing precision is enhanced, the processing time is increased. In addition, there is a problem that a step occurs at the bonding portion and the step thus formed cannot be perfectly removed even by the finishing polishing work.

OBJECT AND SUMMARY OF THE INVENTION

An object of the present invention is to a workpiece surface processing method of processing the surface of a workpiece and a method of forming a semiconductor thin layer which can work the surface of a workpiece with high precision while not being dependent on the thickness precision of the workpiece before the surface processing, can obtain the excellent surface state in a short time and also can collectively work the surface of the workpiece.

In order to attain the above object, a workpiece surface processing method according to a first aspect of the present invention is characterized by comprising the steps of: setting a reference plane in a workpiece; and controlling the reference plane in a desired shape and then removing the material constituting the workpiece from the surface of the workpiece toward the reference plane.

In the workpiece surface processing method according to the first aspect of the present invention, the material constituting the workpiece may be removed so that the workpiece after the surface processing remains partially on the reference plane, or the material may be removed up to the reference plane to thereby expose the reference plane to the outside. The shape of the reference plane (which is a planar shape and means an unevenness state) may be set to any one, and for example, it may be set to a flat shape having a plane surface, a curved shape having a curved surface or the like.

In the workpiece surface processing method according to the first aspect of the present invention, it is preferable that the workpiece is mounted on a mounting table and then the shape of the workpiece holding face of the mounting table is controlled so that the reference plane is controlled to have a desired shape. Here, the control of the shape of the workpiece holding face of the mounting table more specifically means that the workpiece holding face of the mounting table is varied in an uneven shape. In this case, the shape of the workpiece holding face can be controlled with the data of the distance from the surface of the workpiece to the reference plane in the state where the workpiece is mounted on the mounting table. Alternatively, the shape of the workpiece holding face can be controlled with the data of the distance from the workpiece holding face to the reference plane in the state where the workpiece is mounted on the mounting table.

In the workpiece surface processing method according to the first aspect of the present invention, it is preferable to mechanically remove the material constituting the workpiece. In this case, the material constituting the workpiece may be removed by a grinding method, polishing method, a chemical/mechanical/polishing (mechano-chemical polishing) method, a lapping method, a cutting method (sawing method), an etching method, or a combination thereof.

The workpiece of the surface processing method of the workpiece according to the present invention is not limited to a specific one, and a bonding wafer of two semiconductor wafers, bonded glass or the like may be used as the workpiece.

In order to attain the above object, a semiconductor thin layer forming method according to a second aspect of the present invention is characterized in that the surface of a first semiconductor wafer and the surface of a second semiconductor wafer are bonded on each other, a reference plane which is set in the first semiconductor wafer or the second semiconductor wafer is controlled in a desired shape, and then a portion or part of the first semiconductor wafer is removed from the back surface of the first semiconductor wafer to the reference plane to form a semiconductor thin layer from the residual first semiconductor wafer.

As in the case of the workpiece surface processing method of the first aspect of the present invention, in the semiconductor thin layer forming method according to the second aspect of the present invention, the surface of the first semiconductor wafer and the surface of the second semiconductor wafer are bonded to each other (the two semiconductor wafers after bonded to each other are referred to as a "bonded wafer"), then the bonded wafer is mount on the mounting table with the second semiconductor wafer placed at the lower side, and then the shape of the workpiece holding face of the mounting table is controlled to control a reference plane in a desired shape. That is, it is preferable to vary the workpiece holding face on the mounting table in a desired uneven condition. In this case, the shape of the workpiece holding plane can be controlled with the data of the distance from the back surface of the first semiconductor wafer to the reference plane in the state where the bonded wafer is mounted on the mounting table. Alternatively, the shape of the workpiece holding face can be controlled with the data of the distance from the workpiece holding face to the reference plane in the state where the bonded wafer is mounted on the bonding table.

In the semiconductor thin layer forming method of the second aspect of the present invention, it is preferable to mechanically remove a part of portion of the first semiconductor wafer. In this case, the first semiconductor wafer may be removed by a grinding method, a polishing method, a chemical/mechanical/polishing (mechano-chemical polishing) method, a lapping method, a cutting method (sawing method), an etching method, or a combination thereof. The shape of the reference plane (which is a planar shape and means an uneven state) may be set to any shape, and it may be set to a flat shape having a plane, for example.

In the workpiece surface processing method according to the first aspect of the present invention, the material constituting the workpiece is removed from the surface of the workpiece toward the reference plane after the reference plane is controlled in a desired shape. Therefore, the surface processing of the workpiece can be performed with high precision without being dependent on the thickness precision of the workpiece before the surface processing. In addition, the surface processing of the workpiece can be performed with high precision without needing any partial polishing work which has been required in the conventional technique. Therefore, the excellent surface state can be gained in a short time, and the surface of the workpiece can be collectively worked.

In the semiconductor thin layer forming method according to the second aspect of the present invention, the reference plane of the first semiconductor wafer or the second semiconductor wafer is controlled in a desired shape, and then a part of the first semiconductor wafer is removed from the back surface of the first semiconductor wafer toward the reference plane. Therefore, a part of the first semiconductor wafer can be removed with high precision without being dependent on the thickness precision of the first or second semiconductor wafer before the semiconductor thin layer is formed. In addition, a part of the first semiconductor wafer can be removed with high precision without needing any partial polishing work which has been needed in the conventional technique. Therefore, the excellent surface state can be obtained in a short time, and a part of the first semiconductor wafer can be collectively removed.

DETAILED DESCRIPTION OF THE PREFERRED EMBODIMENTS

Preferred embodiments according to the present invention will be described with reference to the accompanying drawings.

[First Embodiment]

Figure 4A:
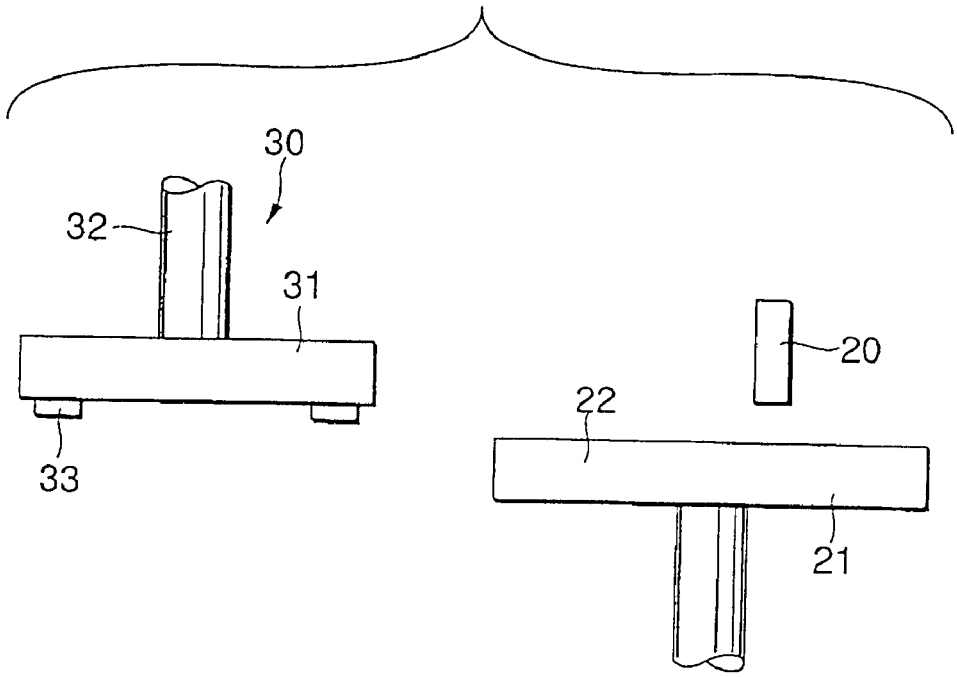
FIG. 4 is a schematic view showing a mounting table, etc. to explain the workpiece surface processing method of the semiconductor thin layer forming method according to the first embodiment of the present invention.

A surface processing method of a workpiece or a semiconductor thin layer forming method according to the present invention will be described by using a first embodiment directed to a method in which a bonded body (bonded wafer) obtained by bonding two silicon semiconductor wafers to each other through an oxide film is used as a workpiece and the bonded wafer is ground from the back surface of one silicon semiconductor wafer to form an SOI wafer. In the first embodiment, after the workpiece (bonded wafer) is mounted on the mounting table, the shape of the workpiece holding face of the mounting table is controlled so that the reference plane (corresponding to the oxide film) has a desired shape. The shape of the workpiece holding face is controlled with the data of the distance from the surface of the workpiece (the back surface of the first semiconductor wafer) to the reference plane in the state where the workpiece (bonded wafer) is mounted on the mounting table. In the first embodiment, the material constituting the workpiece (the first semiconductor wafer) is removed mechanically, more specifically by a grinding method. The surface processing method of the workpiece or the semiconductor thin layer forming method according to the first embodiment will be described with reference to FIGS. 1, 4 and 5. In this embodiment, a vertical-axis rotating type surface grinding machine is used as the grinding machine.

[Step-100]

First, the surface of a first semiconductor wafer 11 which is formed of a silicon semiconductor wafer is thermally oxidized to form an oxide film 12 of 0.3 $\mu$m in film thickness on the surface of the first semiconductor wafer 11. Further, a second semiconductor wafer 13 formed of a silicon semiconductor wafer is prepared. A surface treatment is performed on the first and second semiconductor wafers 11 and 13 with a chemical of a hydrogen peroxide water group such as $NH_4OH/H_2O_2/H_2O$ or $H_2SO_4H_2O_2/H_2O$ to terminate the surface of the first and second semiconductor wafers 11 and 13 with OH-groups and form a bonding face on each of the first and second semiconductor wafers 11 and 13. Thereafter, when the bonding faces of the first and second semiconductor wafers 11 and 13 are brought into contact with each other, the first and second semiconductor wafers 11 and 13 are attached to each other by van der Waals. Thereafter, an anneal treatment at a temperature of 1100° C. and for 2 hours is performed to release the OH-groups, thereby obtaining strong Si—Si coupling. Accordingly, the bonded wafer of the first and second semiconductor wafers 11 and 13 can be achieved (as shown in a schematic partially cross-sectional view of FIG. 1A). In the following description, the bonded wafer of the bonded first and second semiconductor wafers may be merely referred to as "workpiece 10".

[Step-110]

Before the first semiconductor wafer 11 is ground from the back surface thereof, a workpiece holding face 22 of the mounting table 21 on which the workpiece 10 is mounted is subjected to a horizontal position adjustment and a flattening adjustment. That is, the mounting table 21 is moved to the lower side of the measurement device 20 comprising an electrostatic capacity type displacement gauge, and then the workpiece holding face 22 of the mounting table 21 is adjusted so that the workpiece holding face 22 corresponding to the surface of the mounting table 21 is kept in a horizontal and flat position (see FIG. 4A). A specific method of adjusting the attitude of the workpiece holding face 22 of the mounting table 21 will be described later.

[Step-120]

Figure 4B:
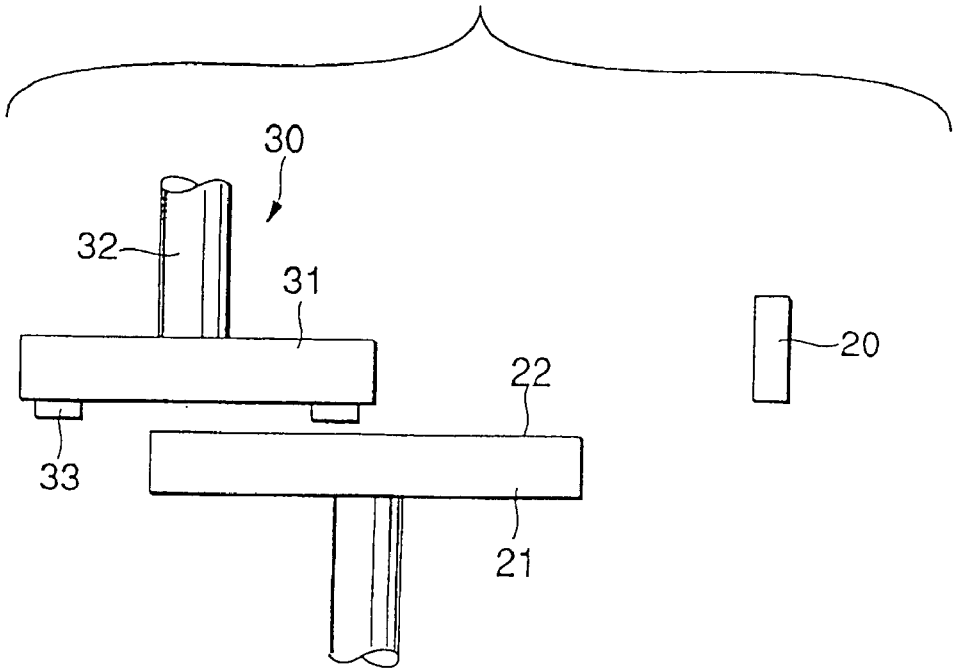

Subsequently, the mounting table 21 is moved to the lower side of the grinding machine 30 to perform the horizontal position adjustment of a grinder fixing plate 31 so that the inclination of the grinder fixing plate 31 to the workpiece holding face 22 of the mounting table 21 is fixed (see FIG. 4B). Further, it is originally preferable that the grinder 33 and the workpiece 10 are set in parallel to each other from the viewpoint of the grinding precision. However, in consideration of the bite of the grinder 33 into the workpiece 10, the grinder 33 is adjusted to be slightly inclined. The grinder 33 is formed of a diamond cup grinder, and the ring-shaped grinder 33 is secured around the outer periphery of the grinder fixing plate 31.

[Step-130]

Figure 1A:
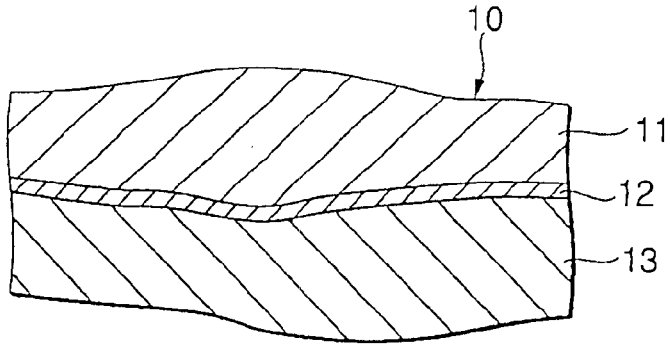
FIG. 1 is a schematic partially cross-sectional view showing a workpiece to explain a workpiece surface processing method and a semiconductor thin layer forming method according to a first embodiment of the present invention.
Figure 1B:
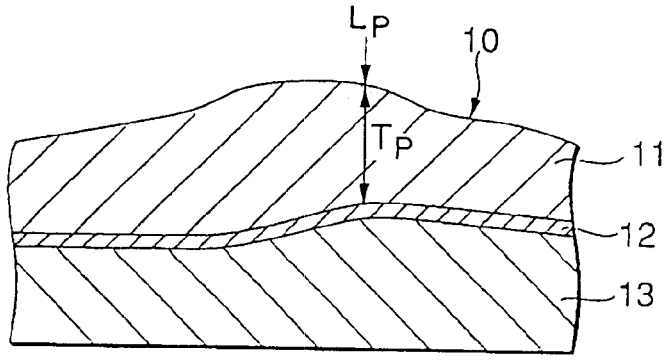
Figure 5A:
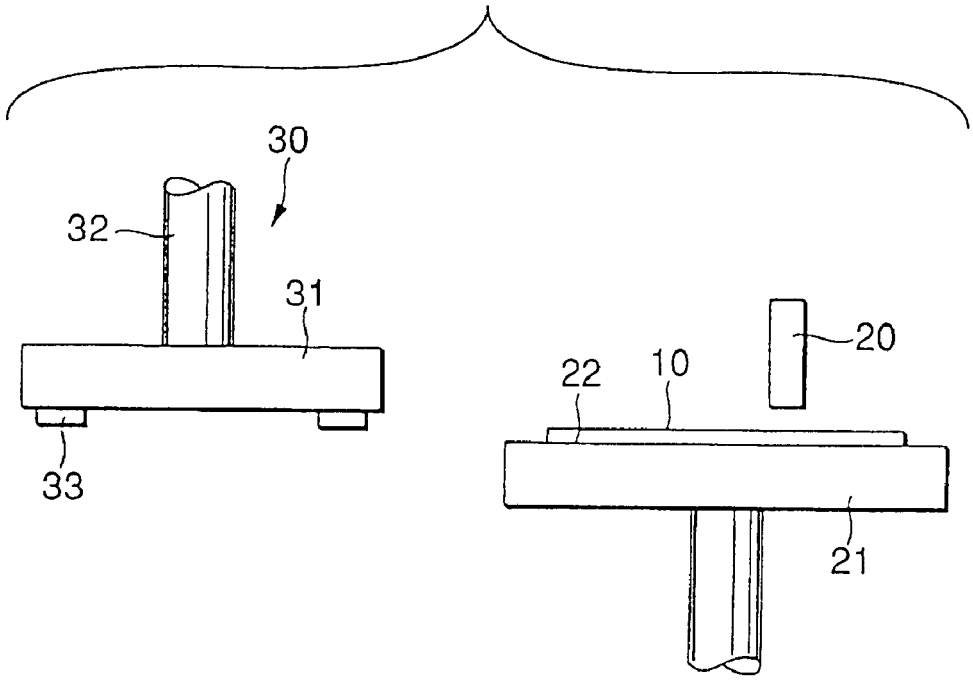
FIG. 5 is a schematic diagram showing a mounting table, etc. to explain the workpiece surface processing method or the semiconductor thin layer according to the first embodiment of the present invention subsequent to FIG. 1.

Thereafter, the mounting table 21 is moved to the lower side of the measurement device 20 again to mount the workpiece 10 on the workpiece holding face 22 of the mounting table 21, and the workpiece 10 is fixed onto the workpiece holding face 22 of the mounting table 21 by a vacuum suction device and a retainer (not shown) which are disposed on the workpiece holding face 22 (see FIG. 5A). In this case, the back surface of the second semiconductor wafer 13 is placed on the workpiece holding face 22. At this time, the workpiece holding face 22 of the mounting table 21 is kept in a horizontal and flat position. FIG. 1B is a schematic partially cross-sectional view showing the workpiece 10 which is fixed onto the mounting table 21. The back surface of the second semiconductor wafer of the workpiece 10 is kept in a substantially flat position because the workpiece holding face 22 of the mounting table 21 is kept in a horizontal and flat position. In the FIGS. 1B to 1D, the mounting table is located at the lower side of the second semiconductor wafer 13, however, it is omitted from the illustration.

In the first embodiment, the oxide film 12 is set as the reference plane. In the state shown in FIG. 5A, the distance from the surface of the workpiece 10 (the back surface of the first semiconductor wafer 11) to the oxide film 12 serving as the reference plane, that is, the thickness of the first semiconductor wafer 11 is measured at predetermined sampling points of the workpiece 10 by the measurement device (not shown) comprising a laser interferometer. Here, the thickness of the first semiconductor wafer 11 at a sampling point P is represented by $T_p$. The distance $L_p$ from the surface of the workpiece 10 (the back surface of the first semiconductor wafer 11) to the measurement device 20 comprising the electrostatic capacitance type displacement gauge at the sampling point is measured.

Thereafter, a correction amount $\Delta T_p$ corresponding to the difference between a predetermined reference thickness $T_0$ and a measured thickness $T_p$ ($=T_{0-Tp}$) is calculated, and the workpiece holding face 22 of the mounting table 21 is varied by only the correction amount $\Delta T_p$. That is, the workpiece holding face 22 of the mounting table 21 is kept to be uneven. The specific method will be described later.

Figure 1C:
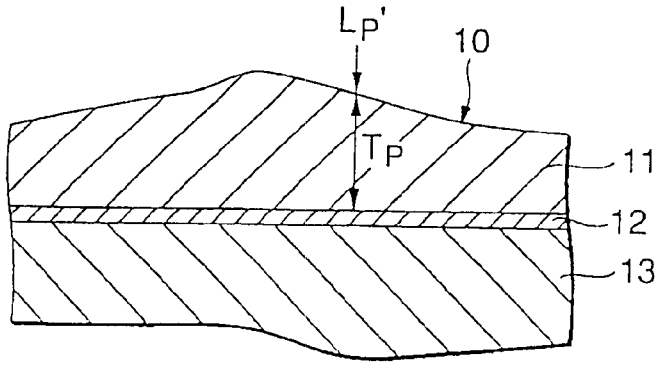

Thereafter, the distance $L_p'$ from the measurement device 20 comprising the electrostatic capacitance type displacement gauge to the surface of the workpiece 10 at the sampling point P is measured, and it is confirmed whether the value of the distance $L_p'$ is equal to $(L_p+\Delta T_p)$ In other words, it is confirmed whether the value of $(L_p'+T_p)$ is substantially constant, whereby the shape of the oxide film 12 serving as the reference plane can be controlled to be a desired shape. Specifically, in the first embodiment, the oxide film 12 serving as the reference plane can be set to have a flat planar shape. FIG. 1C is a schematic partially cross-sectional view showing the workpiece 10 at this state.

[Step-140]

Figure 1D:
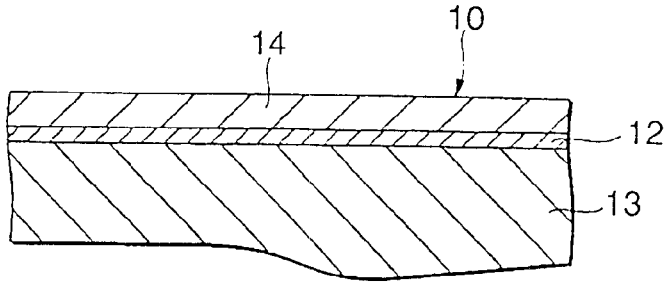
Figure 2A:
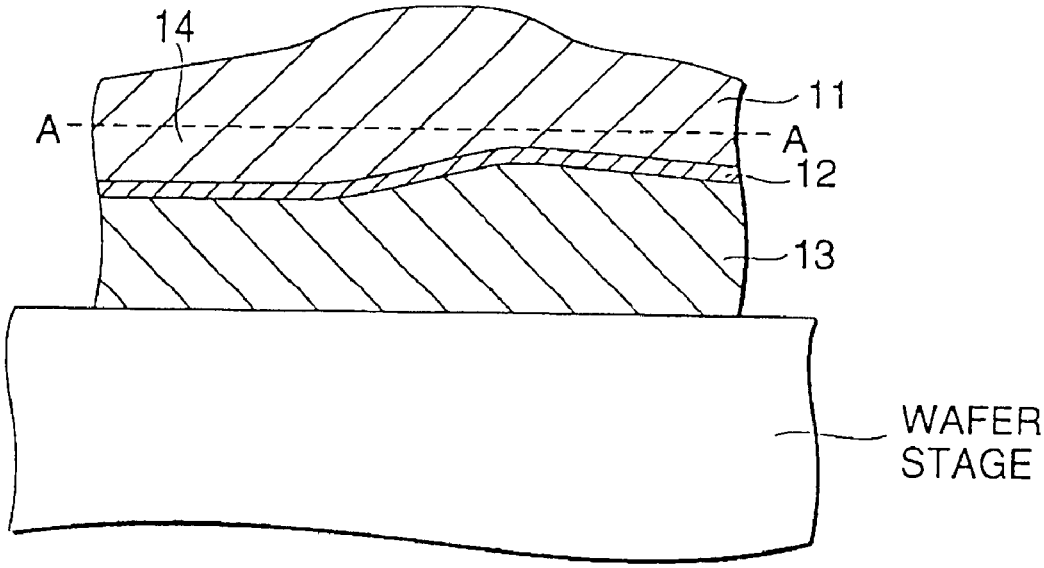
FIG. 2 is a schematic partially cross-sectional view showing a semiconductor wafer, etc. to explain a grinding/polishing state of a semiconductor wafer in a conventional manufacturing process of an SOI wafer.
Figure 2B:
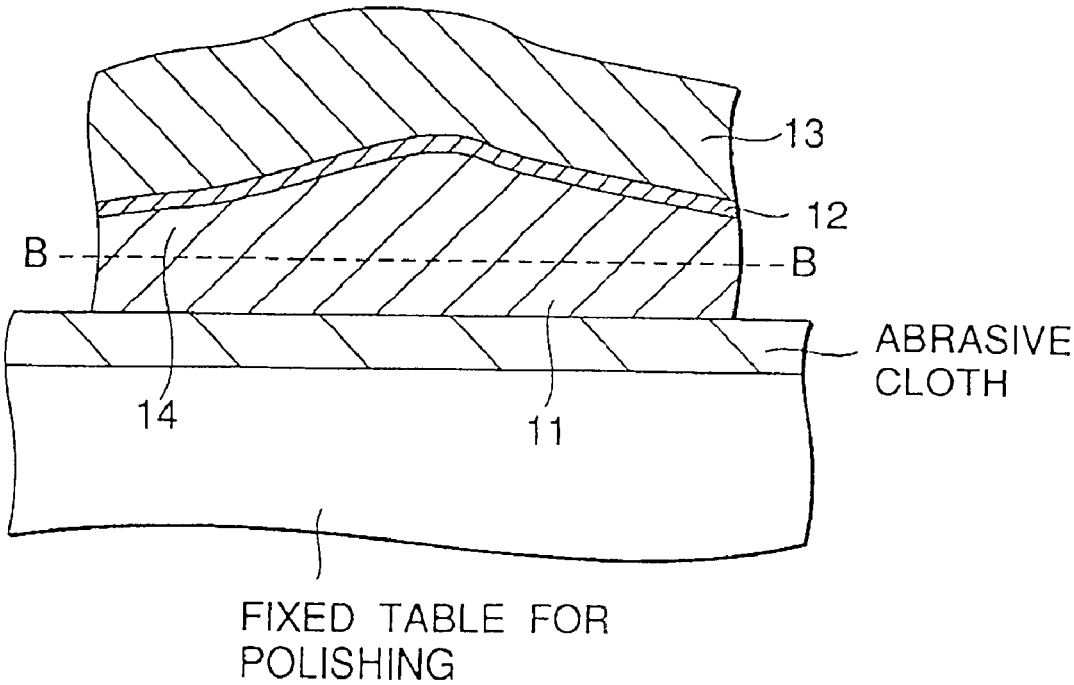
Figure 3:
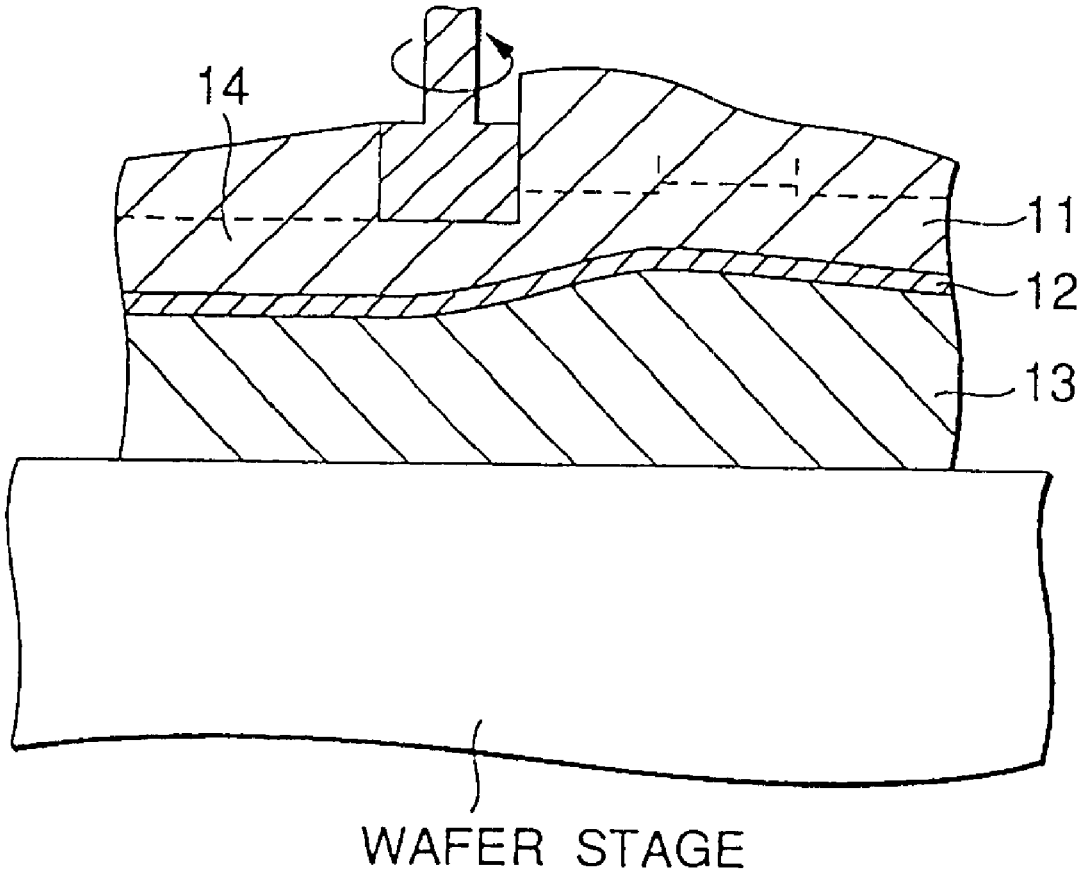
FIG. 3 is a schematic partially cross-sectional view showing a semiconductor wafer to explain the polishing state of a semiconductor wafer in a conventional partial polishing method.
Figure 5B:
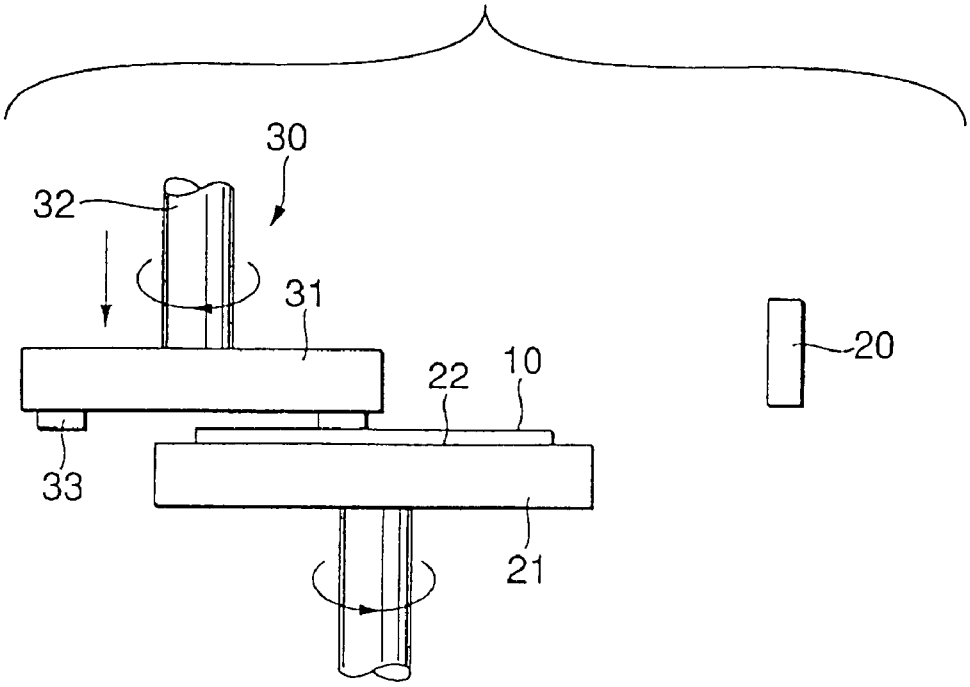

Thereafter, the material constituting the workpiece is removed from the surface of the workpiece 10 (the back surface of the first semiconductor wafer 11) toward the oxide film 12 serving as the reference plane. Specifically, as schematically shown in FIG. 5B, the mounting table 21 on which the workpiece 10 is mounted is moved to the lower side of the grinding machine 30, and the rotational shaft 32 of the grinding machine and the rotational shaft of the mounting table 21 are rotated while the grinding machine 30 is moved downwardly by a desired amount, thereby grinding the first semiconductor wafer 11 from the back surface of the first semiconductor wafer 11. The grinding amount of the first semiconductor wafer 11 can be determined by a downward feeding amount of the grinding machine with the data of $T_p$ and $L_p$ or $L'_p$ which is obtained in [Step-130]. After the material constituting the workpiece is removed by a desired amount, the surface processing of the workpiece 10 is completed. Specifically, at the time when the grinding of the first semiconductor wafer 11 from the back surface thereof by a desired thickness is completed, the grinding is finished. FIG. 1D is a schematic partially cross-sectional view showing the semiconductor thin layer 14 which is formed from the residual first semiconductor wafer 11.

In the first embodiment, after the [step-100] to [step-120] are executed, the workpiece 10 is mounted on the workpiece holding face 22 of the mounting table 21, and then [step- 140] is executed after execution of [step-130 ] or with no execution of [step-130], whereby the first semiconductor wafer 11 is ground from the back surface of the first semiconductor wafer 11 by some degree of amount (thickness). Thereafter, [step-130] may be executed and further [step-140] may be executed. Accordingly, the thickness of the first semiconductor wafer 11, that is, the distance from the surface of the first semiconductor wafer 11 to the oxide film 12 serving as the reference plane can be measured with high precision.

According to the surface processing method or the semiconductor thin layer forming method according to the first embodiment, the surface processing precision or the thickness precision of the semiconductor thin layer 14 is determined by only the precision when the reference plane is set to a desired one (surface adjusting precision) and the processing precision when the material constituting the workpiece is removed from the surface of the workpiece toward the reference plane, not being dependent on the processing precision of the previous step, that is, the dispersion of the thickness of the workpiece 10 in [step-100]. The surface adjustment precision $\sigma_1$ of the workpiece holding face 22 of the mounting table 21 can be set to about ±100 nm. Further, the grinding precision $\sigma_2$ is equal to about ±300 nm. Accordingly, the processing precision of $(\sigma_1^2+\sigma_2^2)^{1/2}=\pm 320$ nm (the thickness precision of the semiconductor thin layer 14) can be obtained. As compared with the conventional method, the processing precision can be more enhanced.

In the above embodiment, the oxide film 12 is set as the reference plane. A virtual plane of the first semiconductor wafer 11 which is located at a position higher than the oxide film 12 by a constant distance may be set as the reference plane. In this case, the material constituting the workpiece (a part of the first semiconductor wafer) may be removed from the surface of the workpiece (the back surface of the first semiconductor wafer) to the reference plane.

Alternatively, in [step-130], the shape of the workpiece holding face 22 may be controlled with the data of the distance from the workpiece holding face 22 to the oxide film 12 in the state where the workpiece 10 is mounted on the workpiece holding face 22 of the mounting table 21. That is, in the state where the workpiece 10 is mounted on the workpiece holding face 22 of the mounting table 21, the height from the workpiece holding face 22 to the oxide film 12 may be measured by the measurement device to vary the unevenness condition of the workpiece holding face 22 of the mounting table 21 with the data of the measurement result.

[Second Embodiment]

Figure 6A:
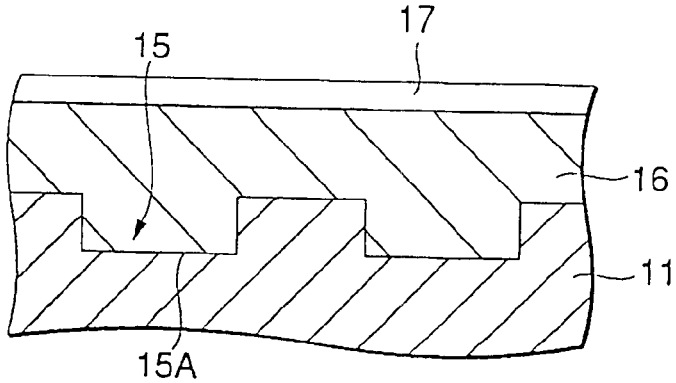
FIG. 6 is a schematic partially cross-sectional view showing the workpiece to explain a workpiece surface processing method or a semiconductor thin layer according to a second embodiment of the present invention.

In a second embodiment, the workpiece surface processing method or the semiconductor thin layer forming method according to the present invention is applied to a process of manufacturing SOI wafers. The workpiece surface processing method or the semiconductor thin layer forming method according to the second embodiment will be described with reference to FIG. 6.

[Step-200]

First, the first semiconductor wafer 11 formed of the silicon semiconductor wafer, excluding a portion at which the semiconductor thin layer will be formed, is subjected to an etching treatment by a plasma etching apparatus or the like, thereby forming a recess portion 15. The depth of the recess portion 15 is equal to the thickness of the semiconductor thin layer to be formed. Thereafter, an insulating layer 16 of $SiO_2$ is formed on the overall surface containing the recess portion 15 by CVD (Chemical Vapor Deposition) method, and the insulating layer 16 thus formed is subjected to a flattening treatment by a polishing method or an etch-back method. Thereafter, a polysilicon (polycrystalline silicon) layer 17 is formed on the insulating layer 16 by the CVD method (see FIG. 6A). Subsequently, on the basis of the same step as [step-100] of the first embodiment, the second semiconductor wafer 13 formed of a silicon semiconductor wafer which is prepared in advance and the first semiconductor wafer 11 are bonded to each other while the surface of the second semiconductor wafer 13 and the polysilicon layer 17 formed on the first semiconductor wafer 11 are brought into contact with each other, thereby obtaining the bonded wafer (see FIG. 6A).

[Step-210]

Thereafter, the same steps of [step-110] to [step-130] of the first embodiment are executed. In the second embodiment, in the same step as [step-130], the bottom surface 15A of the recess portion 15 is set as the reference plane. Therefore, the distance from the surface of the workpiece 10 (the back surface of the first semiconductor wafer 11) to the bottom surface 15A of the recess portion 15 serving as the reference plane is measured at plural predetermined samples of the workpiece 10 by the measuring device comprising the laser interferometer. Further, the distance from the measuring device 20 comprising the electrostatic capacitance type displacement gauge to the surface of the workpiece 10 (the back surface of the first semiconductor wafer 11) is measured at each sampling point.

[Step-220]

Subsequently, the material constituting the workpiece is removed from the surface of the workpiece 10 (the back surface of the first semiconductor wafer) toward the reference plane. In the second embodiment, the first semiconductor wafer 11 is ground from the back surface of the first semiconductor wafer 11 by the same method as [step-140] of the first embodiment. The grinding work is finished at the time when the first semiconductor wafer 11 is left at a thickness of several microns from the reference plane. That is, the first semiconductor wafer 11 is ground from the back surface of the first semiconductor wafer 11 until the position indicated by a dotted line of FIG. 6B.

Thereafter, by using a polishing machine, the first semiconductor wafer 11 serving as the workpiece 10 is ground with no abrasive grain, but with only substance having strong chemical property such as ethylene diamine, whereby the material constituting the workpiece 10, that is, silicon is removed, that is, polished. Subsequently, at the time when the insulating layer 16 of $SiO_2$ begins to be exposed, the grinding of the material constituting the workpiece 10 is completed, whereby the semiconductor thin layer 14 remains between the insulating layers 16 embedded in the recess portion 15 (see FIG. 6C). When the first semiconductor wafer 11 serving as the workpiece 10 is polished by using the polishing machine, it is preferable that the shape of the bottom surface 15A of the recess portion 15 which serves as the reference plane is kept to be controlled. However, the shape of the bottom surface 15A of the recess portion 15 may be kept not to be controlled (in other words, the workpiece 10 is kept to be fixed on the workpiece holding surface 22 while the workpiece holding face 22 of the mounting table 21 is kept in a flat position). Alternatively, the first semiconductor wafer 11 may be ground from the back surface of the first semiconductor wafer 11 until the insulating layer 16 of $SiO_2$ begins to be exposed in the state where the shape of the bottom surface 15A of the recess portion 15 serving as the reference plane is controlled.

In the conventional technique, when there exists any thickness dispersion in the workpiece before polished, a thickness dispersion occurs in the first semiconductor wafer 11 which is left in the grinding process of the first semiconductor wafer 11. As a result, when the first semiconductor wafer 11 is polished, there occurs a case where even when a part of the insulating layer 16 is exposed, the insulating layer 16 is not exposed at the other portion of the first semiconductor wafer 11. Therefore, the polishing process of the semiconductor thin layer 14 in an area where the insulating layer 16 is exposed progresses, and the thickness dispersion occurs in the semiconductor thin layer 14 thus obtained.

Figure 6B:
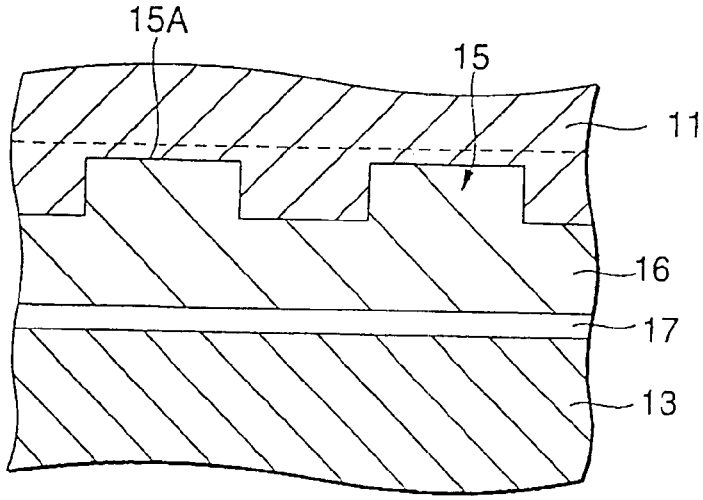
Figure 6C:
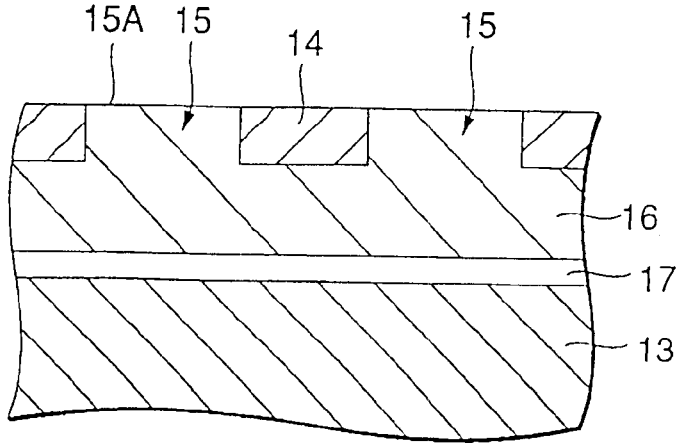
Figure 7:
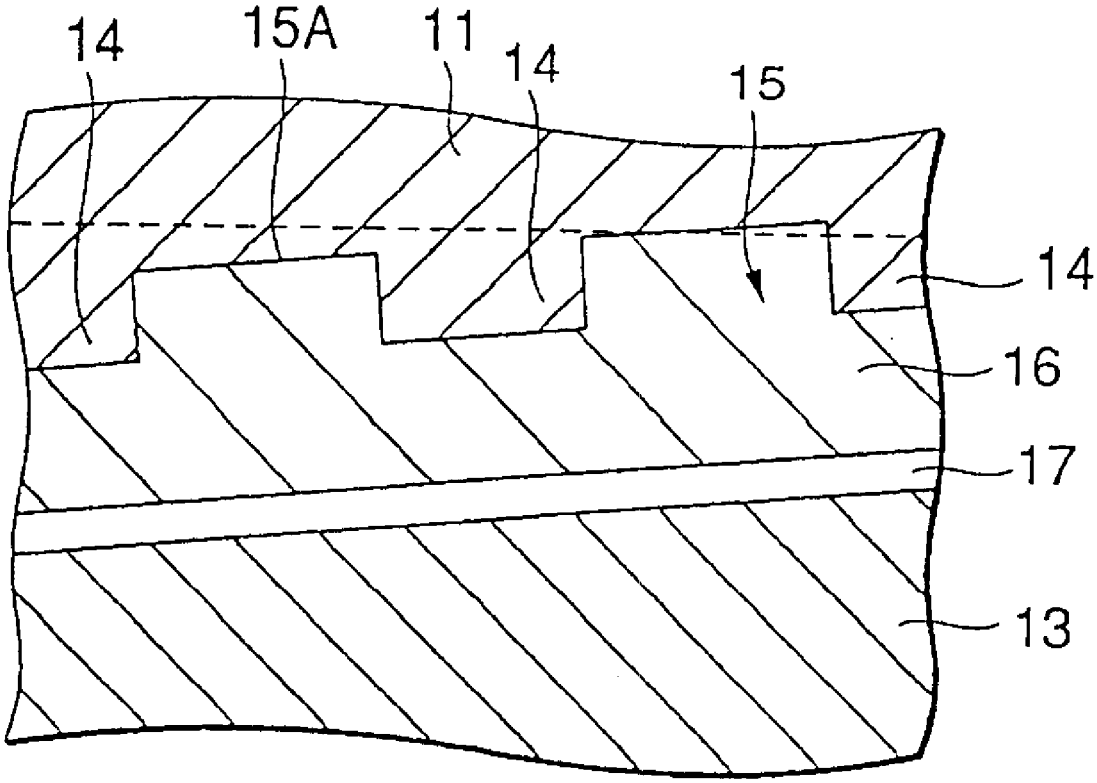
FIG. 7 is a schematic partially cross-sectional view showing a semiconductor wafer, etc. to explain a problem in a conventional selective polishing method.

On the other hand, according to the workpiece surface processing method or the semiconductor thin layer forming method according to the present invention, even when the thickness dispersion occurs in the workpiece 10 before polished, the thickness of the first semiconductor wafer 11 which is left after the grinding process of the first semiconductor wafer 11 (an area located downwardly from the dotted line of FIG. 6B) is made uniform as shown in FIG. 6B because the reference plane is controlled to have a desired shape. Therefore, it can be prevented from inducing such a situation that after a part of the insulating layer 16 is exposed, the insulating layer 16 is not exposed at the other portion of the first semiconductor wafer 11. Accordingly, the thickness dispersion of the semiconductor thin layer 14 thus obtained can be reduced. The processing precision in the grinding process of the first semiconductor can be set to about ±320 nm as in the case of the first embodiment. Further, in the polishing process of the first semiconductor wafer 11, the polishing rate ratio of silicon before and after the insulating layer 16 is exposed can be set to about 50. Therefore, the thickness dispersion of the semiconductor thin layer 14 due to the polishing process is equal to ±320/50=±6.4 nm, and a high thickness precision can be obtained.

In the second embodiment, the shape of the workpiece holding face 22 may be controlled with the data of the distance from the workpiece holding face 11 to the bottom surface 15A of the recess portion 15 serving as the reference plane in the state where the workpiece 10 is mounted on the workpiece holding face 22 of the mounting table 21 in the same step as [step-130] of the first embodiment. That is, in the state where the workpiece 10 is mounted on the workpiece holding face 22 of the mounting table 21, the height from the workpiece holding face 22 to the bottom surface 15A of the recess portion 15 may be measured by the measurement device, and the uneven condition of the workpiece holding face 22 of the mounting table 21 may be varied with the data of the measurement result.

A straightening holding apparatus having a mounting table which is suitably applied to the workpiece surface processing method or the semiconductor thin layer forming method according to the present invention as described above will be described hereunder. In the following description, in order to simplify the description, it is assumed that the surface of the workpiece is set as the reference plane, and the processing for flattening the surface of the workpiece 10 is performed.

Figure 8A:
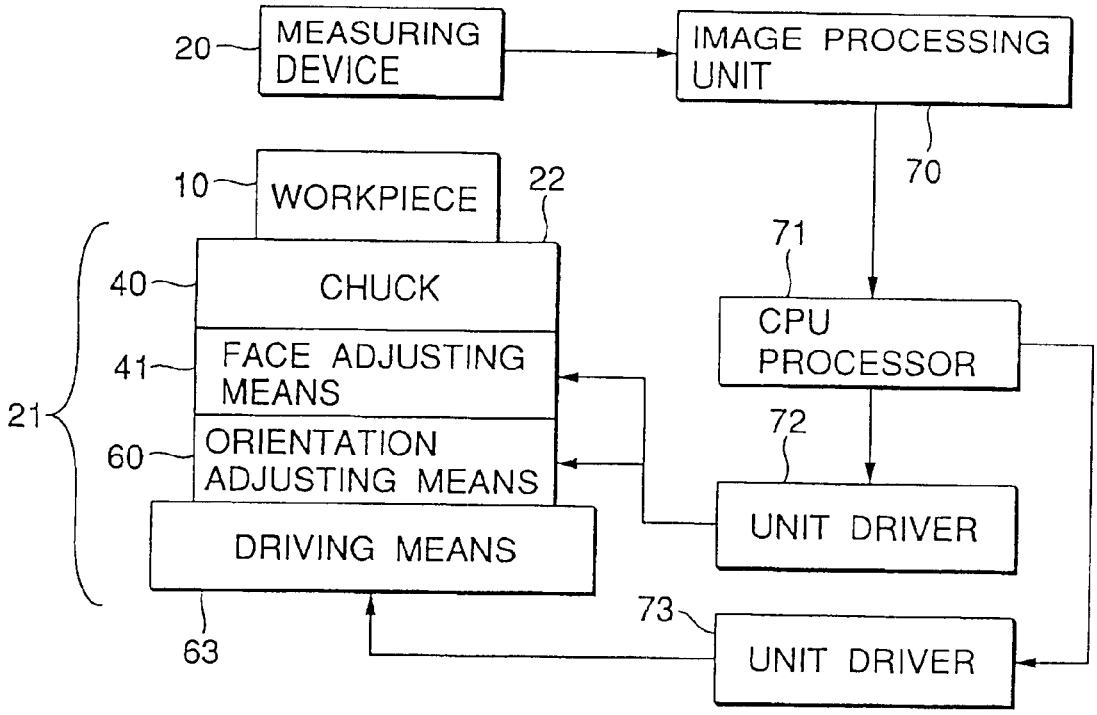
FIG. 8 is a diagram showing a straightening holding device having a mounting table which is suitable for the workpiece surface processing method or the semiconductor thin layer forming method according to the present invention.
Figure 8B:
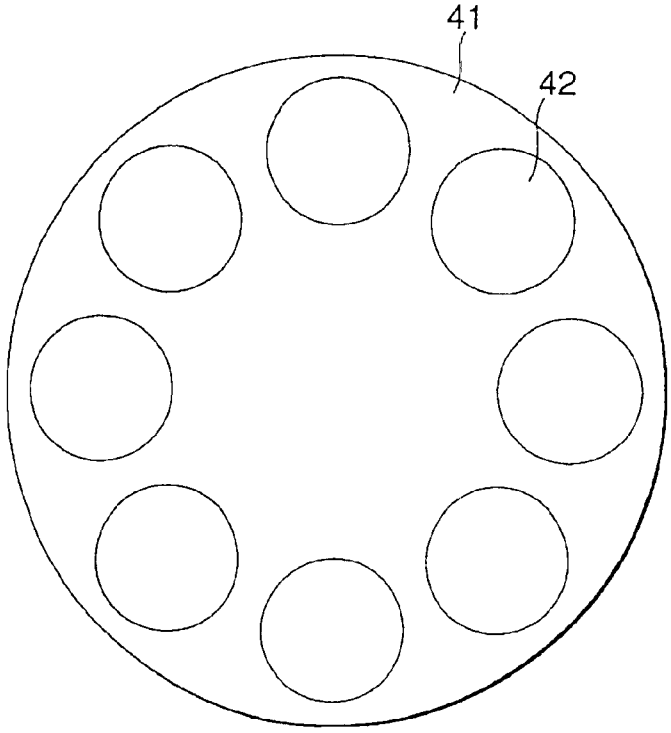
Figure 9:
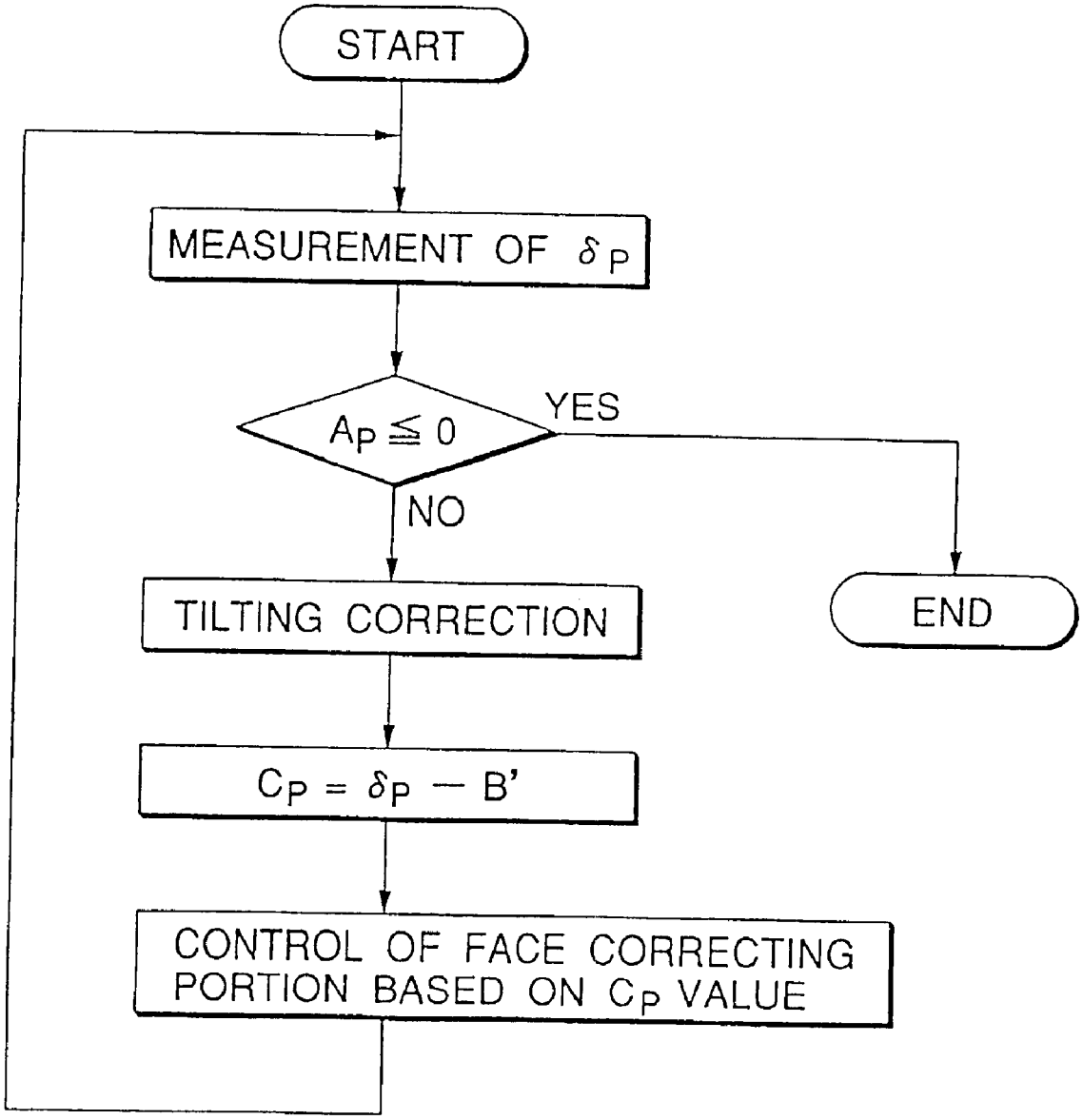
FIG. 9 is a flowchart showing a shape control method of a workpiece holding face on the mounting table which is suitable for the workpiece surface processing method or the semiconductor thin layer forming method of the present invention.

FIG. 8A shows a diagram showing the straightening holding apparatus. The surface adjusting means 41 which constitutes the straightening holding apparatus is schematically shown in a plan view of FIG. 8B. Further, the operation of the straightening holding apparatus is schematically shown in the flowchart of FIG. 9. The straightening holding apparatus includes a mounting table 21 on which the workpiece 10 is mounted, and a measuring device 20 for measuring the shape of the reference plane (for example, the surface) of the workpiece 10 which is mounted on the mounting table 21. The mounting table 21 comprises a chuck 40 having a workpiece holding face 22, the surface adjusting means 41 which is disposed at the lower side of the chuck 40, attitude adjusting means 60 which is disposed at the lower side of the surface adjusting means, and driving means 63 which is disposed at the lower side of the attitude adjusting means 60.

The height from the workpiece holding face 22 to the surface (reference plane) of the workpiece 10 is measured at each predetermined sampling point of the workpiece 10 mounted on the workpiece holding face 22 of the chuck 40.

The chuck 40 is formed of ceramics having a thickness of about 30 mm which mainly contains alumina or the like, and it is provided with a vacuum suction device and a retainer (not shown) to hold the workpiece 10. If the chuck 40 is not designed as described above, that is, if the chuck 40 is too thin, the chuck 40 is locally excessively deformed and thus it is difficult to perform an extremely minute adjustment of the height (unevenness), for example, gentle unevenness of several micrometers or one several-th micrometer.

The surface adjusting means 41 is disposed at the lower side of the chuck 40, and the shape of the chuck 40 (more specifically, the surface shape of the workpiece holding face 22) can be deformed to any shape. Accordingly, the shape of the reference plane of the workpiece 10 which is held in the chuck 40 can be controlled (adjusted). The surface adjusting means 41 is provided with plural surface straightening portions 42 which are vertically moved independently of one another to partially vary the unevenness condition of the workpiece holding face 22 of the chuck 40. In FIG. 8A, eight surface straightening portions 42 are illustrated, however, the number of the surface straightening portions 42 is not limited to eight. For example, the surface adjusting means 41 may be designed so that one surface straightening portion is located at the center of the surface adjusting means 41, six surface straightening portions are located on an outer periphery of the surface adjusting means 41, and six surface straightening portions are located on a further outer periphery of the surface adjusting means 41, that is, totally 13 surface straightening portions 42 are provided.

The attitude adjusting means 60 is disposed at the lower side of the surface adjusting means 41. By the operation of the attitude adjusting means 60, the center axial lines (normal lines) of the surface adjusting means 41 and the workpiece 10 can be inclined to any direction at any angle, whereby when the surface of the workpiece 10 is inclined to a target plane (in general, horizontal plane) as a whole, the inclination can be attenuated.

The driving means 63 is disposed at the lower side of the attitude adjusting means 60, and the attitude adjusting means 60, the surface adjusting means 41, the chuck 40 and the workpiece 10 can be moved in the X-axis (abscissa) and the Y-axis (ordinate) as a whole, or these elements can be rotated around the Z-axis (vertical axis), whereby the workpiece 10 can be moved or positioned, or in some cases the workpiece 10 can be rotated to grind/polish the workpiece 10.

The straightening holding apparatus is provided with an image processing unit 70 and a CPU processor 71. The output from the measurement device 20 is processed by the image processing unit 70, and the unevenness shape of the surface of the workpiece 10 which is measured by the measurement device 20, for example, can be converted to a signal which indicates the height at each sampling point P. The CPU processor 71 processes the signal from the image processing unit 70 to calculate each correction amount, transmits the calculation result to a unit driver 72, and further transmits a driving signal to the unit driver 73. The unit driver 72 drives each surface straightening portion 42 of the surface adjusting means 41 on the basis of the signal corresponding to the correction amount calculation result from the CPU processor 71, and also drives the attitude adjusting means 60 on the basis of a signal indicating a correction amount for the attitude. The unit driver 73 drives the driving means 63 on the basis of the driving signal from the CPU processor 71 to control the movement of the attitude adjusting means 60, etc. in the X-axis and Y-axis directions and the rotation thereof around the Z-axis.

Next, the operation of the straightening holding apparatus will be described with reference to FIG. 9. First, the difference $\delta_p$ between the height of the surface (reference plane) at preset plural sampling points P of the workpiece 10 and the height of the target plane at these sampling points is measured. At the time when this measurement is completed, it is judged whether the measurement result is within a predetermined permissible range $\epsilon$. More specifically, the calculation of $A_p=|\delta_p|-\epsilon$ is performed, and further it is judged whether $A_p \leqq 0$ or $A_p>0$. When $A_p \leqq 0$ at all the sampling points P, the measurement result is within the predetermined permissible range $\epsilon$, and thus the surface adjustment and the attitude adjustment are completed.

When $A_p>0$, the correction amount [−B] to perform the angle adjustment (tilting correction) of the central axial lines of the surface adjusting means 41 and the workpiece 10 by the attitude adjusting means 60 is calculated, and the attitude adjusting means 60 is driven with the data of the correction amount thus calculated. In this case, the calculation target is not directed to all the sampling points, but it may be directed to predetermined main sampling points thereof. This is because the correction amount [−B] would be determined if the inclination between the surface (reference plane) of the workpiece 10 and the target plane (horizontal plane) is determined.

Subsequently, a correction amount which is needed to correct the unevenness of the surface of the workpiece (reference plane). That is, $C_p=\delta_p-B'$ (B' represents a correction amount in consideration of the correction amount B) is calculated. The surface of the workpiece 10 (reference plane) is controlled with the data of the calculation result by vertically moving each surface straightening portion 42 of the surface adjusting means 41 by only the correction amount $[-C_p]$.

Thereafter, the difference $\delta_p$ between the height of the surface at the preset plural sampling points P of the workpiece 10 and the height of the target plane at these sampling points P is measured again, and the above operation is repeated until $A_p \leqq 0$ at all the sampling points P, whereby the entire inclination (the inclination to the target plane) of the surface of the workpiece 10 and the unevenness of the surface (reference plane) can be straightened.

That is, according to the straightening holding apparatus, the inclination of the surface of the workpiece 10 (reference plane) and the shape (unevenness) are measured by the measuring device 20, and the attitude adjusting means 50 and each surface straightening portion 42 of the surface adjusting means 41 are controlled with the data of the measurement result, whereby the inclination of the surface (reference plane) of the workpiece 10 can be straightened and also controlled to a desired shape. Further, this state can be kept. Accordingly, the processing (for example, polishing) of the workpiece can be performed in the state where the reference plane of the workpiece 10 is set to a desired shape.

In [step-110] of the first embodiment, when the horizontal-position adjustment and the flattening adjustment of the workpiece holding face 22 of the mounting table 21 is performed, the horizontal-position adjustment of the surface adjusting means 41 containing each surface straightening portion 42 and the height adjustment of each surface straightening portion 42 may be performed.

Figure 10A:
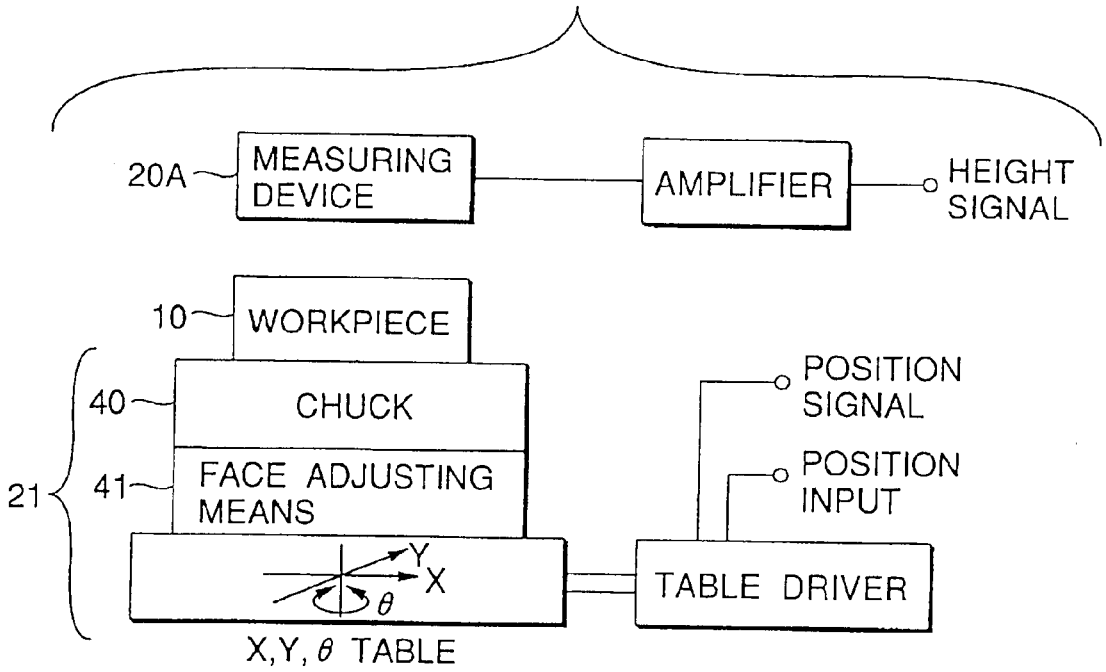
FIG. 10 is a schematic diagram showing an example of a measurement device.
Figure 10B:
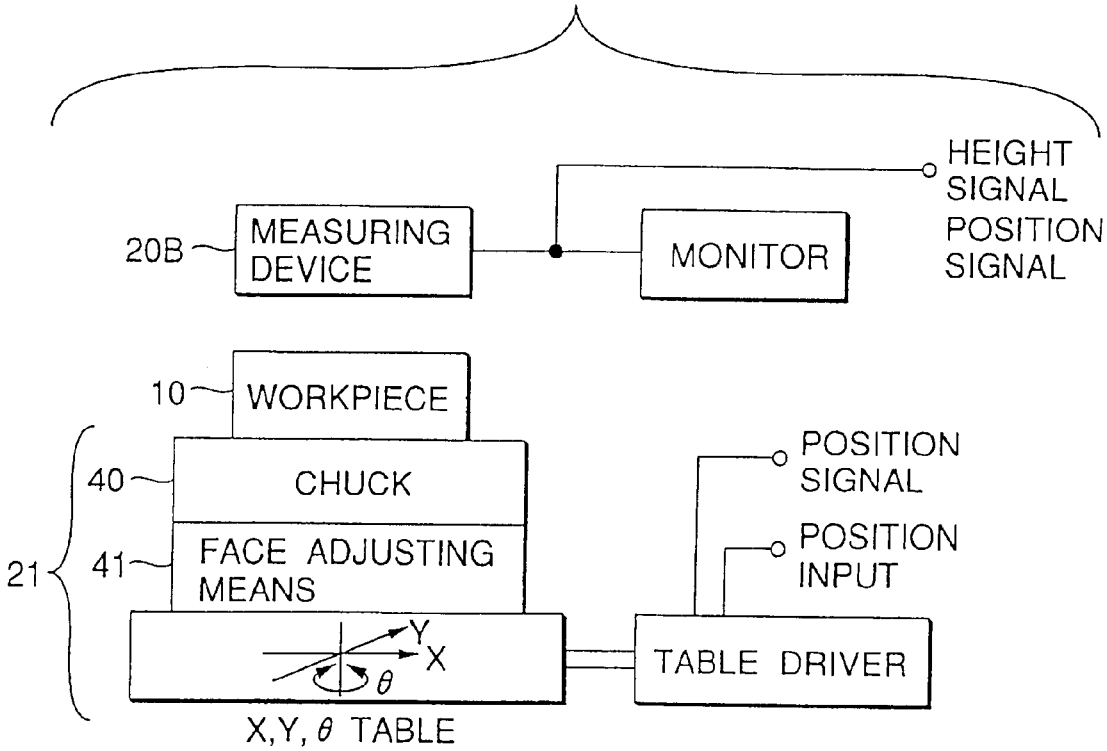

FIGS. 10A and 10B show an example of the measuring device 20. In FIG. 10A, a contactless type displacement gauge (for example, an electrostatic capacitance type displacement gauge) 20A is used as the measuring device 20. The contactless type displacement gauge 20A is located at a fixed position. The height $\delta_p$ of the reference plane (surface) of the workpiece at a predetermined sampling point P can be measured by repeating the measurement while the position of the workpiece 10 is varied by an XYθ table (corresponding to the driving means 63 in the straightening holding apparatus shown in FIG. 8). In this mode, there is an advantage that a system construction can be implemented at a low price. In the case shown in FIG. 10B, a laser interferometer 20 is used as the measuring device. Use of the laser interferometer 20B enables the detection of the unevenness of the substantially overall reference plane (surface) of the workpiece at a short measuring cycle. In addition, the system can be constructed at a low price. However, there is a case where the measurement is impossible due to the property of the reference plane of the workpiece.

Figure 11:
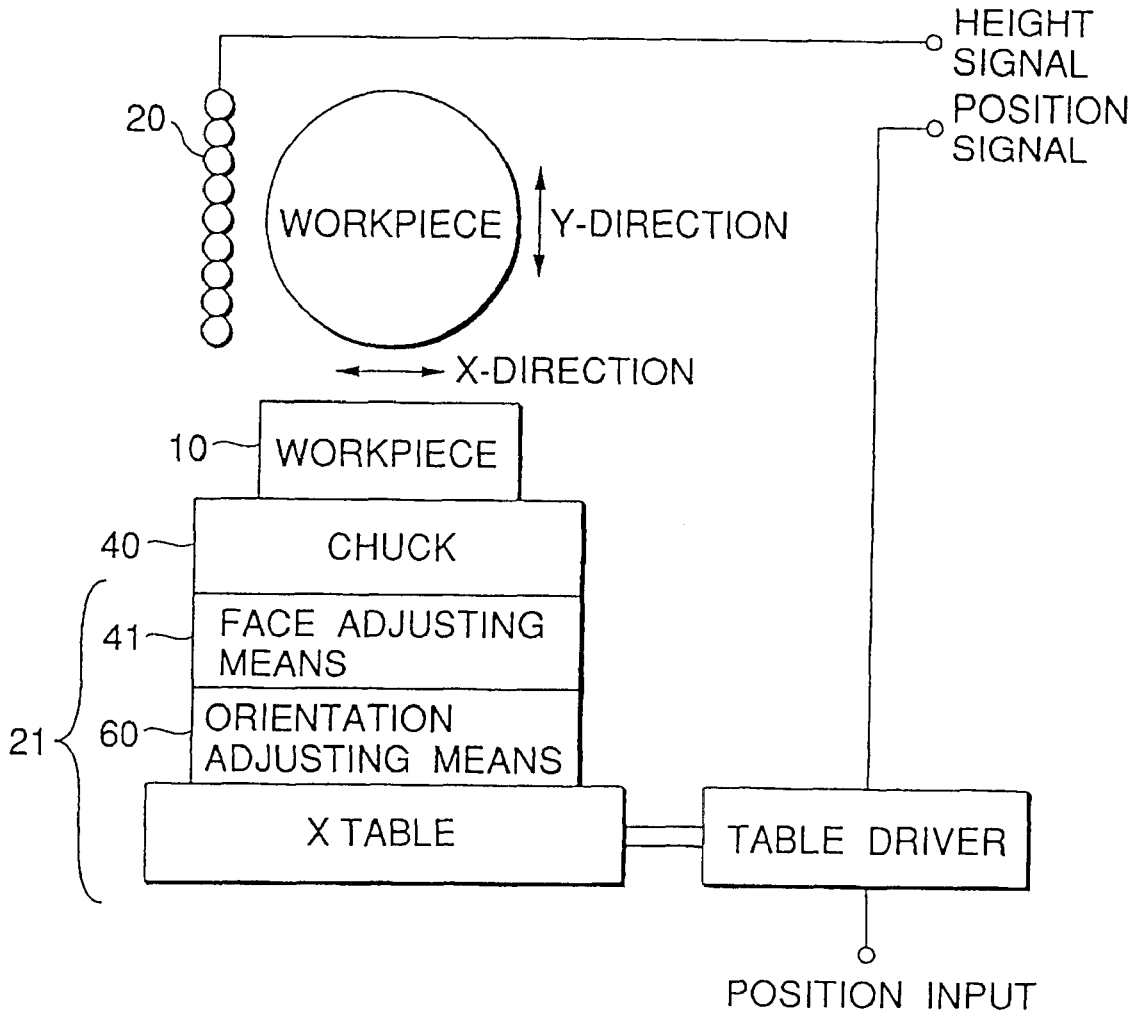
FIG. 11 is a schematic diagram showing an example of the measurement device.

FIG. 11 shows a multi-type in which plural measuring devices 20 (an electrostatic capacitance type displacement gauge, an auto-focus type laser interferometer, a contactless type displacement gauge, etc.) are disposed and the measurements at plural sampling points are simultaneously performed. The upper portion of FIG. 11 is a plan view which schematically shows the arrangement relationship between the workpiece 10 and the measuring device 20, and the lower portion of FIG. 11 is a schematic side view. In FIG. 11, the plural measuring devices 20 are disposed in the Y-axis direction (the vertical direction to the sheet surface in the side view of the lower portion), and the workpiece 10 is driven in the X-axis direction by the X table, whereby the simultaneous measurement at plural sampling points in the Y-axis direction can be performed. The measuring devices 20 may be arranged two-dimensionally in the X-axis direction and in the Y-axis direction to perform the simultaneous measurement in the X-axis direction and the Y-axis direction.

Figure 12:
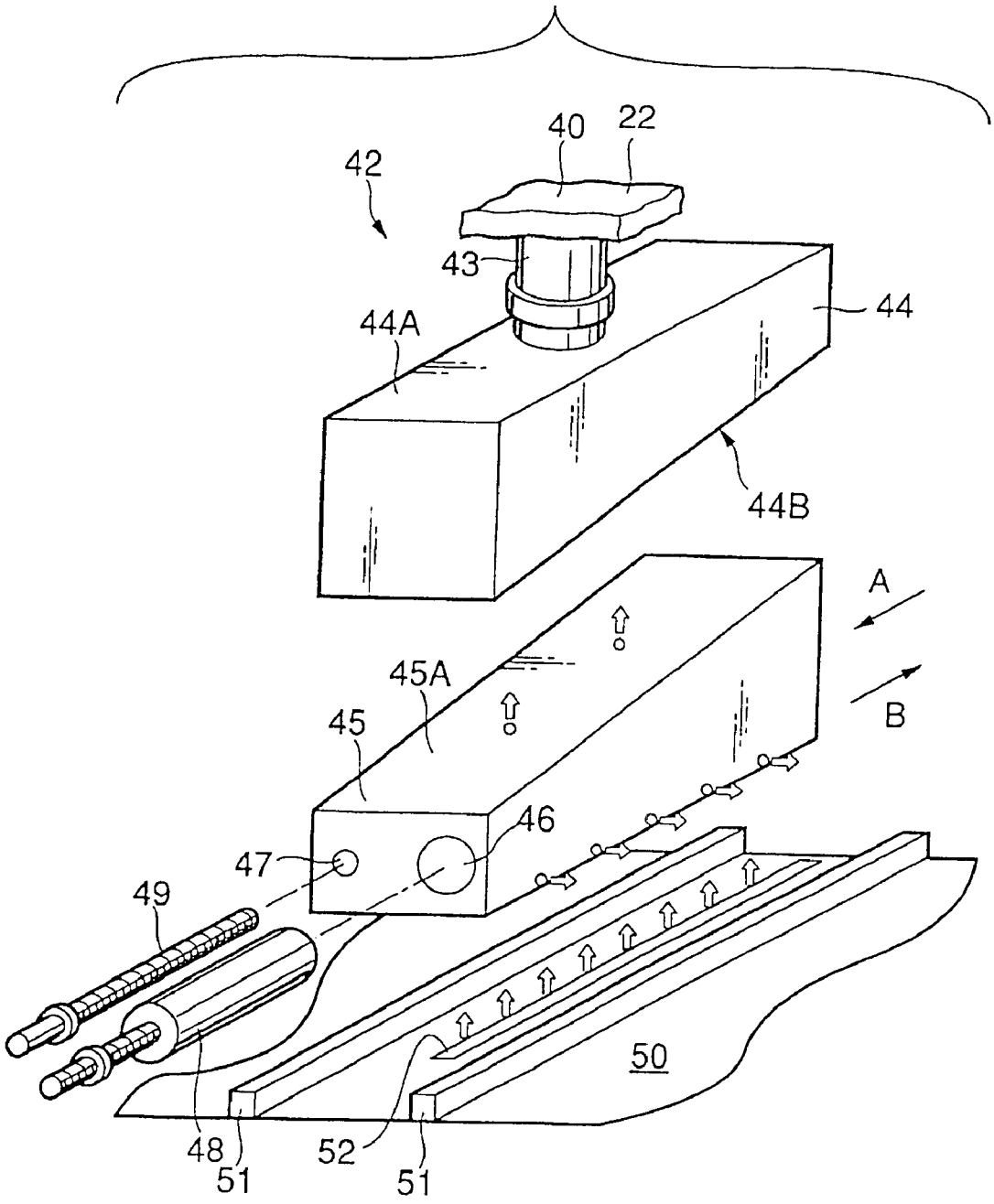
FIG. 12 is a schematic exploded perspective view showing a plane straightening portion.

FIG. 12 is an exploded perspective view showing the surface straightening portion 42. The surface straightening portion 42 is provided with (a) a slide member 45 which is reciprocatively movable in one direction and has a inclination surface 45A which is inclined to the movement direction, and (b) a vertically-movable member 44 which is driven vertically (in the up-and-down direction) interlockingly with the movement of the slide member 45. The vertical movement of the vertically-movable member 44 moves upwardly and downwardly a holder 43 which is secured to the top surface 44A of the vertically-movable member 44, whereby the workpiece holding face 22 of the chuck 40 mounted on the holder 43 can be partially varied upwardly and downwardly.

For example, the slide member 45 which is formed of a rigid body such as stainless steel or the like is disposed on a stage 50. Two parallel projecting portions 51 are provided on the surface of the stage 50, and the slide member 45 is accommodated between these projecting portions 51, whereby the slide member 45 can be reciprocatively moved in only one direction which is parallel to the extending direction of the projecting portions 51. The top surface of the slide member 45 serves as the inclined surface 45A to the above movement direction. The inclination gradient of the inclined surface 45A is set to 1/350, for example.

The slide member 45 is provided with a guide slide hold 46 along the movement direction. A guide 48 for guiding the slide member 45 is slidably inserted into the guide slide hole 46, and a self lock bolt is secured to one end of the guide 48. The slide member 45 is further provided with a screw hole 47 along the movement direction. A positioning bolt 49 is threaded into the screw hole 47. The position of the slide member 45, in other words, the movement amount of the slide member 45 is defined by the rotation of the positioning bolt 49. For example, if the positioning bolt 49 is rotated by 18 degrees, the slide member would be moved by 0.05 $\mu$m.

A fluid flow passage (not shown) is provided in the stage 50, and fluid (for example, compressed air) which is introduced from a fluid inlet port (not shown) provided to the stage 50 flows through the fluid passage, and discharged from a fluid discharging portion 52 provided to the stage 50, whereby the slide member 45 is floated when it is moved and thus the slide member 45 can be moved under a non-contact condition with the stage 50. Accordingly, occurrence of an error in the movement amount and occurrence of stick and slip can be prevented. The apparatus is preferably designed so that the fluid passage is provided in the slide member 45 so that the fluid discharged from the fluid discharge portion 52 is discharged from the side surface and the inclined surface 45A of the slide member 45 through the fluid passage. With this design, the slide member 45 can be moved while it is not brought into contact with the vertically-movable member 44 and the projecting portions 51.

The lower surface 44B (not viewed in FIG. 12) of the vertically-movable member 44 which comprises a rigid body such as stainless steel or the like is an inclined surface which is slid in contact with the inclined surface 45A, and it is inclined along the movement direction of the slide member 45. The inclination gradient is equal to the inclination gradient of the inclined surface 45A of the slide member 45.

The vertically-movable member 44 can be moved upwardly and downwardly, however, it cannot be moved in the plane direction (in the X-axis direction and the Y-axis direction). Accordingly, when the positioning bolt 49 which is threaded into the screw hole 47 is rotated, the slide member 45 is moved to move the vertically-movable member 44 upwardly and downwardly. That is, when the slide member 45 is moved in the direction as indicated by an arrow A of FIG. 12, the vertically-movable member 44 is moved upwardly. On the other hand, when the slide member 45 is moved in the direction as indicated by an arrow B of FIG. 12, the vertically-movable member 44 is moved downwardly.

The holder 43 comprises a preload shaft, for example, and it sucks the chuck 40 downwardly with preload air of 2 Mpa (Mega Pascal). The chuck 40 is deformed in accordance with the height of the vertically-movable member 44 by the suction force. That is, a plurality (eight, thirteen or the like) of surface straightening portions 42 thus constructed are provided. These plural surface straightening portions 42 are independently drive by the unit driver 73, whereby the chuck 40 is partially deformed in accordance with the height of the vertically-movable member 44. As a result, the shape of the reference plane of the workpiece 10 fixed on the workpiece holding face 22 of the chuck 40 can be controlled.

In the grinding/polishing processing work or the like, the processing pressure is applied to the workpiece 10. Therefore, when the rigidity of a holding system (chuck 40, etc.) located at the lower side of the workpiece is low, the surface of the workpiece 10 may be deformed by the processing pressure due to the elastic deformation of the holding system. Occurrence of such deformation induces an error on the reference plane of the workpiece and thus lowers the surface processing precision of the workpiece.

In the above-described mounting table 21, the workpiece 10 is attracted to the chuck 40 under vacuum suction with sufficient suction force. Further, the chuck 40 is strongly attracted to the holder 43 comprising the pre-load shaft under vacuum suction. Accordingly, the workpiece 10 is deformed along the shape of the workpiece holding face 22 of the chuck 40 which is deformed by the operation of the surface straightening portion 42, thereby straightening the reference plane (for example, reducing the unevenness degree). The chuck 40 is formed of a rigid body, and the vertically-movable member 44,the slide member 45, etc. are formed of rigid bodies. In addition, the vertically-movable member 44 and the slide member 45 are brought into direct contact with each other excluding the time when the slide member 45 is moved, so that the elasticity has no effect. Accordingly, in the grinding/polishing process of the workpiece 10, even when any force is applied to the surface of the workpiece 10, the elastic deformation amount of the workpiece due to the force is very small. That is, the elastic deformation amount of the workpiece due to the force which is applied to the surface of the workpiece in the grinding/polishing process, etc. is extremely smaller than the deformation amount of the workpiece due to the control of the reference plane of the workpiece. Accordingly, the surface processing of the workpiece can be performed with high processing precision.

The apparatus may be designed so that the chuck 40 is directly placed on the top surface 44A of the vertically-movable member 44 and the chuck 40 is strongly attracted under vacuum suction by the pre-load shaft which is disposed at a different position from the vertically-movable member 44.

Figure 13A:
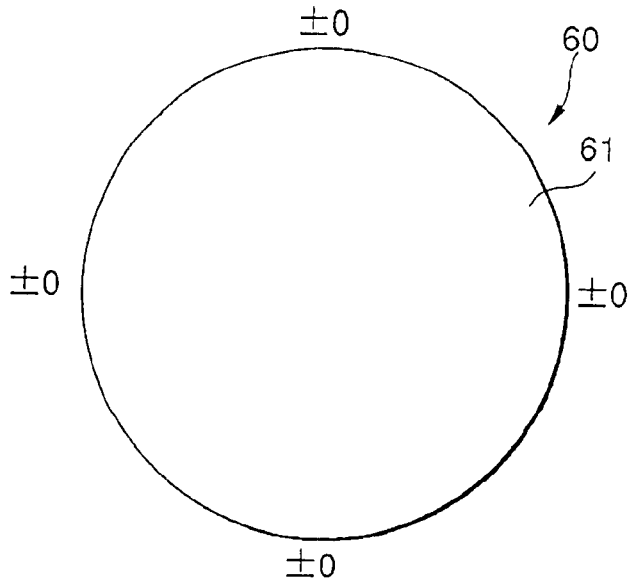
FIG. 13 is a diagram which schematically shows the structure of an attitude adjusting means.
Figure 13B:
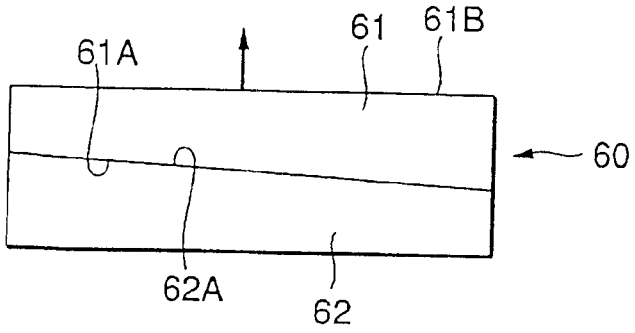
Figure 13C:
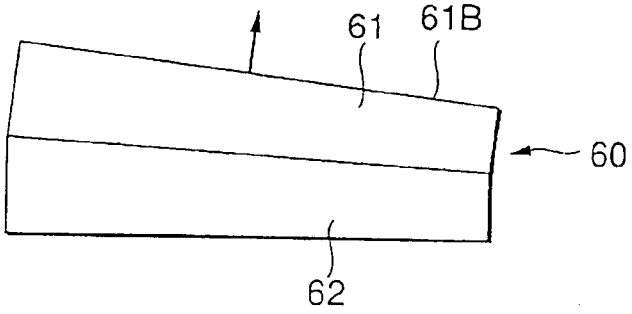
Figure 13D:
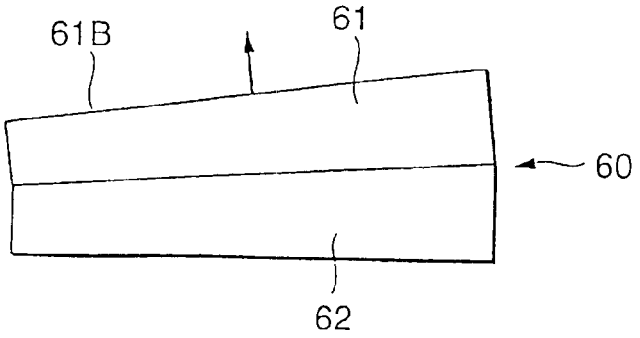

The structure of the attitude adjusting means 60 is shown in FIGS. 13A to 13D. FIG. 13A is a schematic plan view, and FIGS. 13B to 13D are schematic side views. The attitude adjusting means 60 comprises a pair of members (a surface displacing member 61 and a base member 62). These pair of members may be formed as follows. A cylindrical or a barrel-shaped body which comprises a rigid body of stainless steel or the like and has a diameter of 200 mm is cut by an inclined plane which obliquely intersects to the center axis line of the cylindrical or barrel-shaped body, thereby dividing the body into two parts vertically. The surface displacing member 61 and the base member 62 have inclined surfaces 61A and 62A corresponding to the cutting faces respectively. The surface displacing member 61 and the base member 62 are slidably rotated so that they are not displaced from each other around the center axis line while the inclined surfaces 61A and 62A are kept in contact with each other, whereby the angle (inclination) of the top surface 61B of the surface displacing member 61 can be varied. Further, by integrally rotating the surface displacing member 61 and the base member 62, the direction of the normal of the top surface 61B can be varied. The surface adjusting means 41 containing the respective surface straightening portions 42 is mounted on the surface adjusting means 41. The base member 62 is mounted on the driving means 63.

The height difference between the inclined surfaces 61A and 62A is set to 5 $\mu$m, for example. In the arrangement state of the surface displacing member 61 and the base member 62 shown in FIGS. 13A and 13B, the normal of the top surface 61B (as indicated by the arrow) is coincident with the vertical direction. As schematically shown in FIG. 13C, the normal of the top surface 61B (as indicated by the arrow) is coincident with the direction extending from the lower left side to the upper right side on the drawing by rotating only the surface displacing member 61 from the state shown in FIG. 13B by 180 degrees. And, as schematically shown in FIG. 13D, the normal of the top surface 61B (as indicated by the arrow) is coincident with the direction extending from the lower right side to the upper left side on the drawing by rotating only the base member 62 from the state shown in FIG. 13B by 180 degrees. Further, the inclination of the normal is set to be in the range from −5 $\mu$m to +5 $\mu$m per 100 mm in radius by the relative rotation between the base member 62 and the surface displacing member 61. Accordingly, in order to attain the inclination in the range by the calculation result, the relative rotation of the base member 62 and the surface displacing member 61 by the amount corresponding to the inclination may be performed. Further, the direction of the normal of the top surface 61B can be made coincident with a desired direction by integrally rotating the base member 62 and the surface displacing member 61 while the relative positional relationship between the base member 62 and the surface displacing member 61 are kept. The rotation of the base member 62 and the surface displacing member 61 can be performed by providing a gear tooth on the periphery of each member and giving the rotational force through the gear, or by giving a rotational force with a rack or pinion.

According to the attitude adjusting means 60 as described above, the inclination and direction of the normal of the top surface 61B of the surface displacing member 61 can be freely varied to desired values within a predetermined angle range. After the inclination and direction of the normal of the top surface 61B of the surface displacing member 61 are adjusted, the base member 62 and th surface displacing member 61 are fixed under pressure by a lock cylinder (not shown) and further the attitude adjusting means 60 is fixed to the driving means 63.

Figure 14:
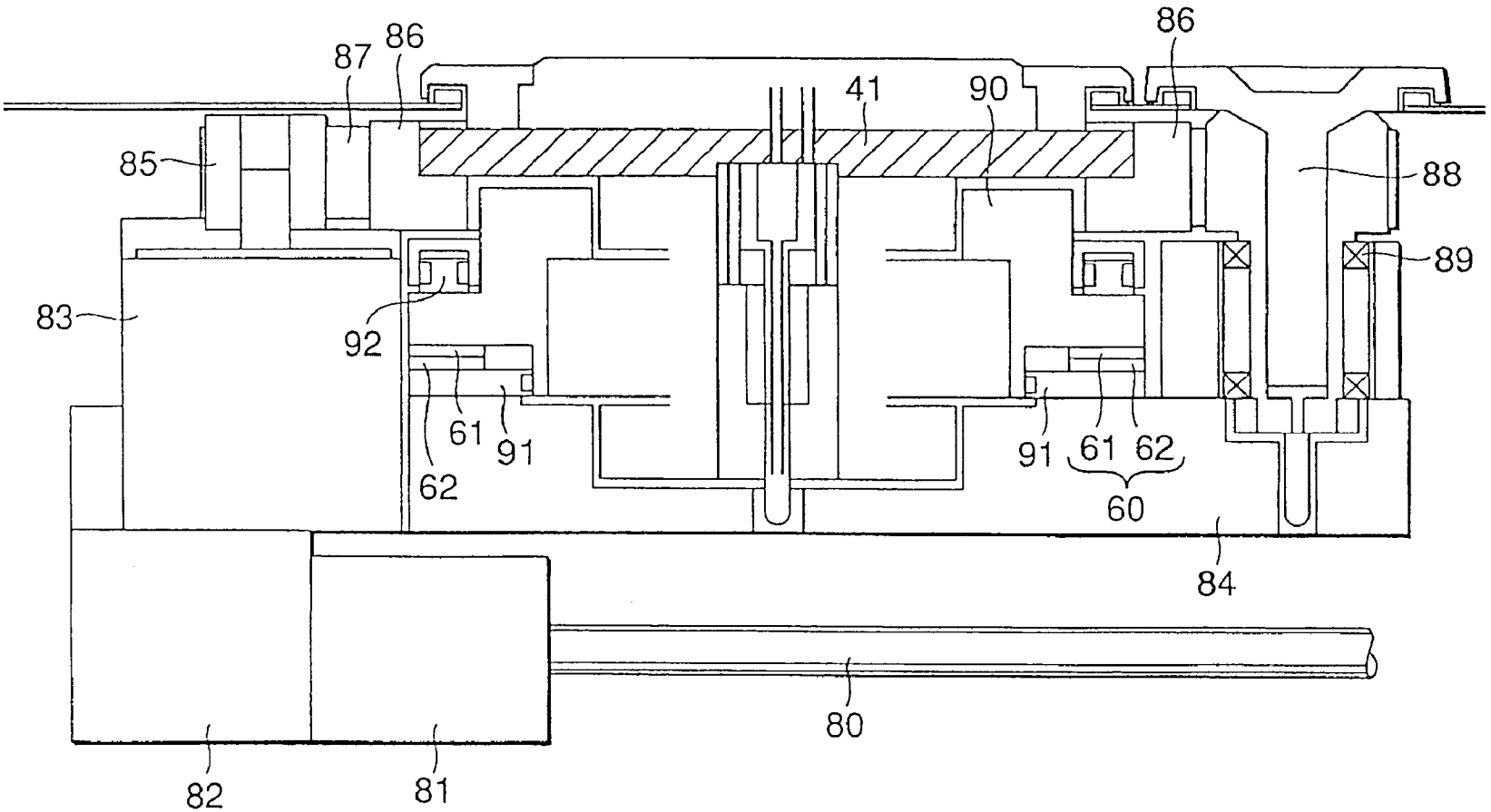
FIG. 14 is a cross-sectional view showing an installation example of the mounting table in a polishing device.

FIG. 14 is a schematic cross-sectional view showing a case where the mounting table is installed in a polishing machine. The polishing machine contains, in the X-axis direction, a rotational screw 80, a nut 81 which is threaded into the rotational screw 80 and a moving member 82 which is integrated with the nut 81. Further, a servo motor 83 and a slide table 84 are supported by the moving member 82. The moving member 82 can be moved in the X-axis direction by the rotation of the rotational screw 80. As a result, the overall mounting table can be moved in the X-axis direction. Further, the servo motor 83 is provided with a pulley 85, and a pulley 86 is also provided to the outer peripheral surface of the surface adjusting means 41 (which is hatched for convenience's sake). The rotational force of the pulley 85 can be transmitted to the pulley 86. Numeral reference 88 represents an idler for keeping the tension of a plain belt 87 to a predetermined value or more, reference numeral 89 represents a deep groove ball bearing for the idler 88, and reference numeral 90 represents a bearing housing. Reference numeral 91 represents an air bearing unit which is secured to the slide table 84. The mount table secured inside the bearing housing 90 and the air bearing unit 91 is rotated by actuating the servo motor 83. The surface displacing member 61 and the base member 62 which constitute the attitude adjusting means 60 is disposed between the bearing housing 90 and the air bearing unit 91. After the inclination and direction of the normal of the top surface 61B of the surface displacing member 61 in the attitude adjusting means 60 are adjusted, the base member 62 and the surface displacing member 61 is fixed under pressure by the lock cylinder 92, and further the attitude adjusting means 60 can be fixed to the bearing housing 90 and the air bearing unit 91.

The present invention is not limited to the above-described embodiments. In the above embodiments, the measurement of the thickness of the first semiconductor wafer is performed by using the laser interferometer, and the measurement of the distance from the measuring device to the back surface of the first semiconductor wafer is performed by using the electrostatic capacitance type displacement gauge. However, the methods for measuring the thickness and the distance are not limited to the methods using the measuring device, and any method may be used. Further, the surface processing of the workpiece is performed by the grinding process or the combination of the grinding process and the polishing process. However, another processing method or the combination of the grinding method, the polishing method and another method may be used in accordance with the shape and the property of the workpiece.

According to the workpiece surface processing method or the semiconductor thin layer forming method of the present invention, the surface processing of the workpiece or the formation of the semiconductor thin layer can be performed with high precision while not dependent on the thickness precision of the workpiece before the surface processing or the thickness dispersion of the first or second semiconductor wafer, and the surface roughness can be suppressed. In addition, the surface processing of the workpiece can be performed with high precision without performing a partial polishing work which has been used in the conventional technique. Therefore, an excellent surface state or an excellent semiconductor thin layer can be obtained in a short time. In addition, the surface of the workpiece or the semiconductor substrate can be collectively processed. Therefore, the processing time can be shortened, the processing cost can be reduced and the processing yield can be enhanced. Further, the surface processing is not dependent on the thickness precision of the workpiece before the surface processing is performed, or the thickness dispersion of the first and second semiconductor wafer before the semiconductor thin layer is formed. Therefore, the various treatments/processing of the workpiece and the semiconductor wafer before the surface processing of the workpiece or the formation of the semiconductor thin layer are facilitated, so that the total process can be performed in a shorter time, the cost can be reduced and the processing yield can be enhanced.

What is claimed is:

1. A surface processing method for a workpiece, comprising the steps of:

setting a reference plane in the workpiece;

controlling a shape of said reference plane to a planar shape by deforming the workpiece; and then removing material constituting the workpiece from the surface of the workpiece toward said reference plane.

2. A workpiece surface processing method as claimed in claim 1, wherein after the workpiece is mounted on a mounting table, the shape of a workpiece holding face of said mounting table is changed to control the shape of said reference plane.

3. A workpiece surface processing method as claimed in claim 2, wherein the shape of said workpiece holding face is controlled with measured values of the distance from the surface of said workpiece to said reference plane in the state where said workpiece is mounted on said mounting table.

4. A workpiece surface processing method as claimed in claim 2, wherein the shape of said workpiece holding face is controlled with measured values of the distance from said workpiece holding face to said reference plane in the state where said workpiece is mounted on said mounting table.

5. A workpiece surface processing method as claimed in claim 1, wherein the material constituting said workpiece is mechanically removed.

6. A workpiece surface processing method as claimed in claim 5, wherein the material constituting said workpiece is removed by a grinding method.

7. A workpiece surface processing method as claimed in claim 1, wherein said workpiece comprises two semiconductor wafers which are bonded to each other.

8. A semiconductor thin layer forming method comprising the steps of:

bonding the surface of a first semiconductor wafer and the surface of a second semiconductor wafer to each other to form a composite;

controlling a shape of a reference plane which is set in one of said first semiconductor wafer and said second semiconductor wafer to have a planar shape by deforming the composite; and then removing said first semiconductor wafer from the back surface of said first semiconductor wafer toward said reference plane to form a semiconductor thin layer from the residual first semiconductor wafer.

* * * * *